US006501059B1

(12) United States Patent
Mast

(10) Patent No.: US 6,501,059 B1
(45) Date of Patent: Dec. 31, 2002

(54) HEAVY-METAL MICROWAVE FORMATIONS AND METHODS

(76) Inventor: Roy Lee Mast, 2200 Huntington Dr., Plano, TX (US) 75075

( * ) Notice: Subject to any disclaimer, the term of this patent is extended or adjusted under 35 U.S.C. 154(b) by 0 days.

(21) Appl. No.: 09/404,150

(22) Filed: Sep. 27, 1999

(51) Int. Cl.[7] ..... H05B 6/80

(52) U.S. Cl. ..... 219/730; 219/728; 219/759; 426/107; 426/234; 99/DIG. 14

(58) Field of Search ..... 219/730, 729, 219/728, 759; 426/107, 109, 241, 243, 234; 99/DIG. 14

(56) References Cited

U.S. PATENT DOCUMENTS

| | | | | |
|---|---|---|---|---|
| 4,230,924 A | * | 10/1980 | Brastad et al. | 219/730 |
| 4,552,614 A | | 11/1985 | Beckett | |
| 4,610,755 A | | 9/1986 | Beckett | |
| 4,685,997 A | | 8/1987 | Beckett | |
| 4,883,936 A | | 11/1989 | Maynard et al. | |
| 4,908,246 A | | 3/1990 | Fredricks et al. | |
| 4,914,266 A | | 4/1990 | Parks et al. | |
| 4,927,991 A | | 5/1990 | Wendt et al. | |
| 4,959,120 A | | 9/1990 | Wilson | |
| 5,038,009 A | | 8/1991 | Babbitt | |
| 5,079,397 A | * | 1/1992 | Keefer | 219/730 |
| 5,117,078 A | * | 5/1992 | Beckett | 219/728 |
| 5,182,425 A | * | 1/1993 | Pescheck et al. | 219/730 |
| 5,185,506 A | | 2/1993 | Walters | |
| 5,213,902 A | | 5/1993 | Beckett | |
| 5,220,143 A | | 6/1993 | Kemske et al. | |
| 5,254,821 A | | 10/1993 | Walters | |
| 5,300,746 A | | 4/1994 | Walters et al. | |
| 5,530,231 A | | 6/1996 | Walters et al. | |
| 5,614,259 A | | 3/1997 | Yang et al. | |
| 5,698,127 A | | 12/1997 | Lai et al. | |

FOREIGN PATENT DOCUMENTS

| | | |
|---|---|---|
| WO | WO 89/04585 | 5/1989 |
| WO | WO 96/34810 | 11/1996 |
| WO | WO 98/08752 | 3/1998 |

* cited by examiner

*Primary Examiner*—Philip H. Leung
(74) *Attorney, Agent, or Firm*—David W. Quimby

(57) ABSTRACT

A microwave laminate for heating, browning, and crisping food products is provided. The microwave-absorbing region of the laminate is formed from electrically conducting film of shielding thickness. The film is patterned to provide an increased effective electrical sheet resistance that allows the susceptor to substantially absorb rather than reflect microwave energy. Also, a microwave susceptor underlay or shield formed from a patterned electrically conducting film of shielding thickness is provided for controlling temperature gradients within microwave susceptors.

43 Claims, 21 Drawing Sheets

HEAVY-METAL MICROWAVE FORMATIONS AND METHODS

FIELD OF THE INVENTION

The present invention generally relates to the field of structures for enhancing the heating, browning, and crisping of food products in microwave ovens. More particularly, the present invention pertains to microwaveable structures that have patterned conductive formations of a relatively large thickness that can be selectively modified to substantially absorb, reflect, and/or focus microwave radiation. The present invention further pertains to susceptor underlays that incorporate patterned conductive films for controlling temperature gradients within microwave susceptors.

BACKGROUND OF THE INVENTION

In the following description reference is made to certain structures and methods. However, such references are not to be construed as an admission of prior art. Applicants reserve the right to dispute that such structures and methods qualify as prior art against the present invention.

Microwave susceptors are conductive structures that undergo heating when exposed to microwave radiation and are commonly employed in microwave food packaging to tailor the heating, crisping, and browning of microwave food products. A typical susceptor is a laminated structure comprised by a thin, microwave-absorbing layer disposed between a polymer barrier layer and a structural backing layer. Thin films of aluminum are most commonly used. Such a susceptor is typically formed by depositing a thin metallic film onto a polymer film substrate. The metallized polymer film is then often laminated to the structural backing layer. The laminate may then be used to form packaging for food products.

When exposed to microwave radiation, microwave-absorbing layers formed from appropriately thin metal films absorb a portion of the microwave energy and undergo resistive (ohmic) heating due to the electrical currents induced within the metal layer. Such absorbing metal layers are exceedingly thin and typically possess sheet resistances of 20–500 Ω/□ (ohms per square of the material—the ohms per square value can be obtained by cutting a square of any length on a side and measuring the resistance between two sides of the square with an ohm meter). It is impractical to measure the thicknesses of such films directly, and, therefore, their thicknesses are commonly specified in terms of optical density, which increases with metal thickness. For aluminum, sheet resistances of 20–500 Ω/□ correspond to optical densities of approximately 0.10–0.70. The sheet resistance typically decreases as the optical density (i.e., thickness) increases.

Numerous susceptors are described in the prior art. Exemplary susceptors are disclosed in U.S. Pat. Nos. 5,530,231, 5,220,143, 5038,009, 4,914,266, 4,908,246, and 4,883,936, the disclosures of which are incorporated herein by reference.

Though conventional microwave susceptors are capable of heating, browning, or crisping microwave food products, the results of their use have not been entirely satisfactory. During use, conventional susceptors may undergo nonuniform heating when exposed to microwave radiation, causing some regions of a food product to be undercooked and other regions to be overcooked. Such non-uniform heating may result inherently from the susceptor itself, from microwave oven "hot spots" corresponding to regions of greater microwave intensity, or from non-uniform contact of the food product with the susceptor. In addition, conventional susceptors may overheat, become damaged, and cease to function as desired. Specifically, susceptor overheating is typically accompanied by shrinkage of the polymer layer or layers, leading to cracking (crazing) of the metallic layer. As a result, the susceptor may become less absorbing to microwave radiation and more transmitting, and the food product may, therefore, receive a greater amount of conventional dielectric heating from the microwave radiation than desired.

A number of approaches have emerged to address the above-mentioned problems. One of these involves the patterning of conventional metal microwave-absorbing layers by selective demetallization to control the amount of heating in predetermined regions of the susceptor. Another patterning approach entails disrupting rather than demetallizing microwave-absorbing layers in selected regions of susceptors. A number of techniques have been utilized to provide the desired patterning. Exemplary techniques are described in U.S. Pat. Nos. 5,614,259, 4,959,120, 4,685,997, 4,610,755, and 4,552,614, the disclosures of which are incorporated herein by reference.

Other approaches that address susceptor deficiencies utilize a separate shielding layer or device that substantially reflects and/or focuses microwave energy traveling from a microwave source before it reaches a microwave-absorbing susceptor layer. Metal layers of such shielding behavior have a relatively large thickness when compared with metallic susceptor layers formed from the same material by vacuum metallization techniques, hereafter also referred to as heavy-metal layers, typically possess sheet resistances of 1.0–5.0Ω/□ and optical densities on the order of 1.0–2.5. As a result, such metal layers are relatively less absorbing than thinner metal layers and undergo substantially less heating when exposed to microwave radiation. Numerous shielding and/or intensifying structures are described in the prior art. Exemplary structures are disclosed in U.S. Pat. Nos. 5,300,746, 5,254,821, 5,185,506, and 4,927,991, the disclosures of which are incorporated herein by reference.

The use of heavy-metal microwave shields and focusing structures in conjunction with microwave-absorbing structures has been carried out with varying degrees of success and has been difficult to apply commercially. The benefits obtained by using such conventional structures are often offset by the increased complexity and expense of processing packaging materials with two or more metallic layers of different thicknesses. In an environment where packaging materials are disposable, minimizing complexity and cost while enhancing functionality is an important concern.

Accordingly, it is apparent that a significant need exists for simple, cost-effective microwaveable structures and formations that provide reliable, well-defined microwave heating, browning and/or crisping in predetermined regions and in predetermined amounts.

SUMMARY OF THE INVENTION

The present invention satisfies these and other objects by providing microwaveable formations comprising a heavy-metal layer (or layers) that is (are) selectively patterned to act as a microwave-absorbing layer, microwave shielding layer, and/or microwave focusing layer, all having the same thickness.

According to a first aspect of the present invention, a microwave laminate is provided comprising a first layer substantially transparent to microwave energy having an electrically insulating surface and at least one microwave-absorbing region of patterned electrically conducting film of substantially shielding thickness contiguous with the electrically insulating surface of the first layer. Each microwave-absorbing region is patterned to provide an increased effective electrical sheet resistance that allows the microwave-absorbing region to substantially absorb rather than reflect microwave energy. Thus a microwave susceptor is formed from an electrically conducting film that would ordinarily reflect a substantial portion of incident microwave energy if it were not patterned in a manner to absorb microwave energy.

The present invention further provides a package for microwave heating of food products comprising a first layer substantially transparent to microwave energy having a first surface disposed near or supporting an intended food product. At least one microwave-absorbing region of patterned electrically conducting film of substantially shielding thickness is disposed on at least the first surface of the first layer. Each microwave-absorbing region is patterned to provide an effective electrical sheet resistance that allows the microwave-absorbing region to substantially absorb rather than reflect microwave energy.

The present invention further satisfies the above-mentioned objectives, and others, by providing a microwave susceptor underlay comprising a heavy-metal film having a particular pattern and corresponding properties. The invention further provides a substantially non-absorbing microwave susceptor underlay comprising patterned regions of electrically conducting film of substantially shielding thickness disposed on a first layer substantially transparent to microwave energy having an electrically insulating surface. The microwave susceptor underlay may be positioned beneath a heavy-metal or conventional microwave susceptor or may be laminated to an electrically insulating surface of either type of microwave susceptor.

BRIEF DESCRIPTION OF THE DRAWING FIGURES

DETAILED DESCRIPTION OF THE INVENTION

According to a first embodiment of the invention, a continuous heavy-metal film has a sheet resistance which is typically in the range of 2.0–5.0 Ω/□ and has an optical density on the order of 1.5–3.0 and would ordinarily substantially reflect microwave radiation. According to the invention, such heavy metal films may be patterned by appropriate techniques to have much higher effective electrical sheet resistances and, hence, may be selectively made to perform as either microwave susceptors or as microwave shields.

Figure 1A:
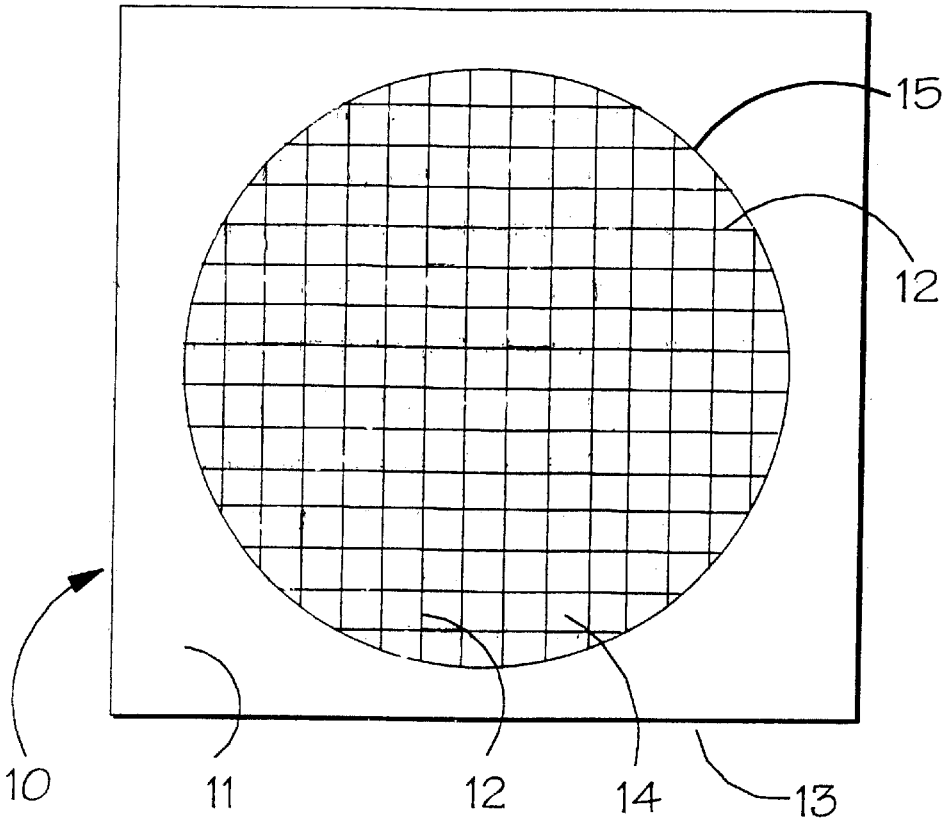
FIG. 1A is a plan view of a heavy-metal susceptor in one embodiment of the present invention.
Figure 1B:
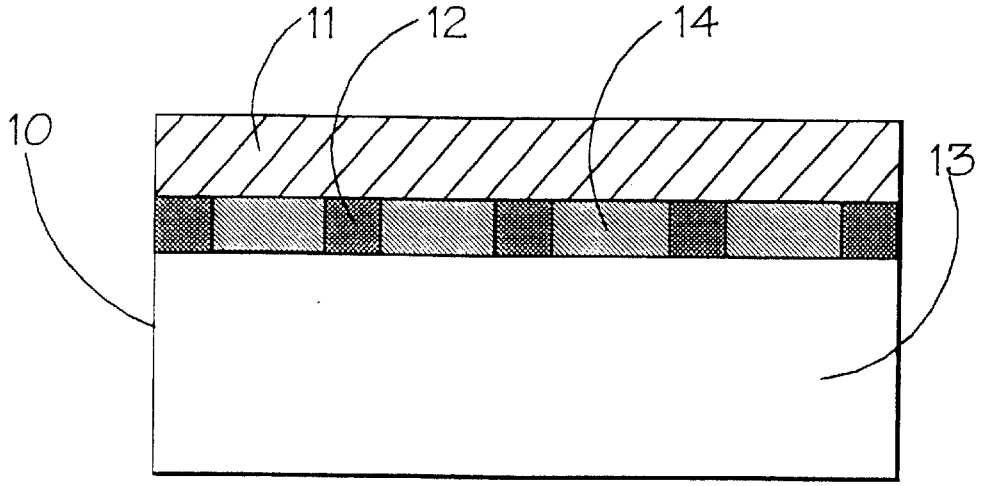
FIG. 1B is a cross-sectional view of the heavy-metal susceptor according to FIG. 1A.
Figure 2:
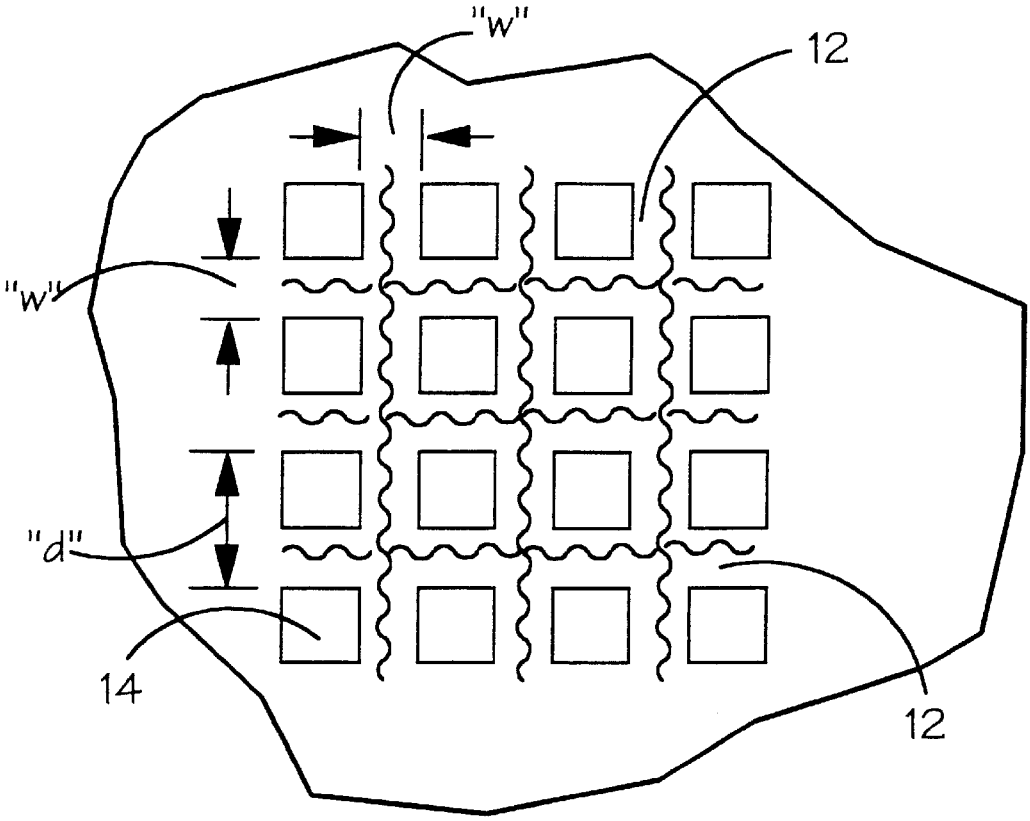
FIG. 2 is a plan view of a portion of a heavy-metal susceptor of the present invention illustrating the width and separation of the metallic grid lines.

A first embodiment of a microwaveable device 10 according to the principles of the present invention is illustrated in FIGS. 1A, 1B, and 2. The device 10 comprises a microwave-absorbing region 15 of patterned electrically conducting heavy-metal film or layer, such as aluminum, in the overall pattern of a circle. This pattern may be incorporated into a laminate suitable to construct food packaging. For instance, the patterned heavy-metal film may be disposed between an electrically insulating polymer barrier layer 11, such as 0.5 mil thick polyester, and an electrically insulating backing layer 13, such as 20 mil thick food-grade paperboard. The microwave-absorbing region 15 is comprised by a subpattern of interconnected heavy-metal grid lines 12 disposed perpendicularly to each other. Heavy-metal grid lines 12 define nonconducting squares 14 between adjacent grid lines. Nonconducting squares 14 may be in the form of empty voids, voids filled with an adhesive, or squares of nonconducting material. It should be noted that FIGS. 1A and 1B are not drawn to scale, and, further, that the thicknesses of the polymer barrier layer 11 and the heavy-metal grid lines 12 are greatly exaggerated for the purpose of illustration.

A heavy-metal susceptor, such as the device or susceptor 10 shown in FIGS. 1A and 1B, may be generally fabricated by depositing a heavy-metal film of substantially shielding thickness onto a polymer barrier layer using any suitable technique, such as vacuum evaporation, sputtering, or another suitable deposition method. Selective demetallization may then be carried out. Preferably, droplets of liquid etchant, such as sodium hydroxide (NaOH), are deposited on the aluminum metallized surface of the polymer barrier layer in a desired pattern of microwave-absorbing regions, each region having a desired subpattern. The etchant may be deposited by printing techniques such as dot matrix printing, line screening, half-tone printing, etc. After rinsing the metallized polymer barrier layer to remove the etch product, a desired pattern of electrically conducting microwave-absorbing regions having associated subpatterns remains. Subsequent drying and lamination of the metallized and patterned polymer barrier layer to a backing layer provides a completed susceptor.

The thickness of the heavy-metal microwave-absorbing region 15 in the first embodiment illustrated in FIGS. 1A and 1B is such that, if unpatterned (i.e., a continuous film), the metal layer would possess a sheet resistance in the range of 0.5–10.0 Ω/□, or more preferably, 2.0–5.0 Ω/□. As noted above, continuous metal films of this thickness substantially reflect microwave radiation and do not undergo substantial heating when exposed to microwave radiation. With appropriate patterning, however, heavy-metal films of this thickness may acquire a higher effective sheet resistance and become adapted to substantially absorb rather than reflect microwave radiation. The origin of this higher effective sheet resistance may be explained with reference to the first embodiment and FIG. 2, which provides a magnified view of the heavy-metal microwave susceptor 10 illustrated in FIGS. 1A and 1B.

As indicated in FIG. 2, the heavy-metal grid lines 12 possess a width w and a center-to-center separation d. It is known that the resistance of an electrical conductor is proportional to the both the resistivity and length of the conductor and inversely proportional to the cross-sectional area of the conductor perpendicular to the direction of current flow. Accordingly, using this knowledge and known rules for combining resistances, the following equation may be derived for the effective electrical sheet resistance of the patterned heavy-metal structure illustrated in FIG. 2, where a is the resistance of the unpatterned film in Ω/□:

$$\text{Effective resistance (in } \Omega/\square) = (d-w)(\alpha/w) + w(\alpha/d).$$

For example, in the first embodiment illustrated in FIGS. 1A, 1B, and 2, a continuous aluminum film with a sheet resistance of 4.0 Ω/□ may be subsequently demetallized to produce a subpattern of aluminum grid lines 12 of width w=0.4 mm and center-to-center separation d=8.4 mm in the overall pattern of a circular microwave-absorbing region 15. The effective electrical sheet resistance of the subpattern of aluminum grid lines 12 given by the aforementioned equation is 80.2 Ω/□. This effective electrical sheet resistance is well within the sheet resistance regime of microwave-absorbing layers appropriate for use in microwave susceptors.

It may be noted that the effective sheet resistance indicated in the aforementioned equation is given by the sum of two terms. The first of these terms, (d−w)(α/w), dominates the value of the effective sheet resistance as w is reduced, providing potentially large values of effective sheet resistance. In contrast, the second term of the sum, w (α/d), becomes negligible compared to the first term as w is reduced. The net effect is an increased effective sheet resistance as the width, w, of the grid lines 12 is reduced.

It is also possible, consistent with the principles of the present invention to pattern the heavy metal film as described below such that the overall sheet resistance still falls within the shielding range, and therefore still acts as a shield, albeit a potentially less effective shield than a solid heavy metal film.

Figure 3A:
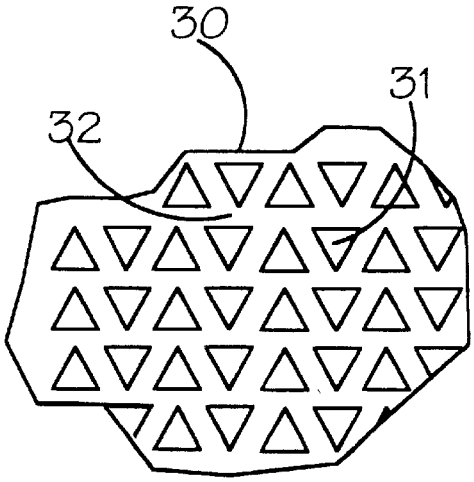
FIG. 3A is a plan view illustration of an alternative pattern for heavy-metal microwave-absorbing regions.
Figure 3B:
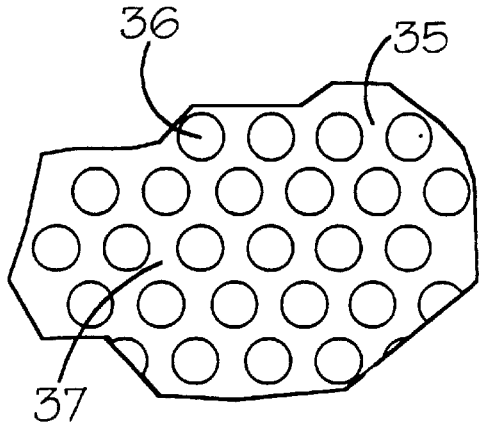
FIG. 3B is a plan view of another alternative pattern for heavy-metal microwave-absorbing regions.

The heavy-metal susceptor 10 according to the first embodiment illustrated in FIGS. 1A, 1B, and 2 has been described by reference to a heavy-metal microwave-absorbing region 15 with a square-grid subpattern. However, it should be understood that the present invention is not limited to this particular subpattern. When the grid 12 is viewed as a collection of individual conductive paths, each with a relatively small cross-sectional area, it is evident that selective demetallization of a heavy-metal layer could be carried out in many conceivable subpatterns to reduce the cross sectional areas of the individual conductive paths, thereby increasing the effective sheet resistance of the heavy-metal layer. Other possible subpatterns include those shown in FIGS. 3A and 3B. FIG. 3A illustrates a heavy-metal microwave-absorbing region 30 characterized by a triangular array of equally spaced triangular non-conductive areas 31. Separating the areas 31 are interconnected heavy-metal grid lines 32 disposed at angles of approximately 60 degrees relative to each other forming a conductive triangular grid. FIG. 3B illustrates a heavy-metal microwave-absorbing region 35 characterized by a triangular array of equally spaced circular non-conductive regions 36. The regions 36 are separated by a continuous matrix of heavy-metal film 37.

In addition, it is believed that the demetallization need not occur in a regular pattern at all. It is expected that the etching of closely spaced voids with a predetermined range of sizes in random locations can also provide the increased effective sheet resistance that enables the invention.

A central concept of this embodiment of the present invention being that by an appropriate patterning utilizing any suitable technique, a metallic layer susceptor having a sheet resistance of approximately 60–120 Ω/□ can be produced. A susceptor being a material which produces significant amounts of heat when exposed to electromagnetic radiation in a microwave oven. Therefore, according to the present invention, even an aluminum foil which has a thickness which is about 1000 times greater than a conventional metallized susceptor layer can be turned into a susceptor. One factor that must be considered in forming a susceptor from a metallized foil is that the openings formed in the metal layer must be of such dimensions and number so that impinging electromagnetic energy is intercepted by the susceptor, instead of just flowing through the susceptor. A susceptor in the form of a grid will intercept electromagnetic energy at a frequency of 2.4.6 Hz if the center-to-center separation distance of adjacent metal islands or formations (d) is approximately 1 cm or less.

Another advantage of a heavy metal susceptor formed according to the present invention is its ability to function safely and effectively. As noted above, microwave oven "hot spots" can cause conventional thin film microwave-absorbing layers to overheat. As a result of such overheating the adjacent laminate, typically an insulative polymer, is in turn damaged, often leading to cracking, crazing and arcing, etc. Patterned heavy metal microwave absorbing layers according to the present invention substantially avoids the above-mentioned problems caused by such hot spots. For example, in the grid-type pattern of FIGS. 1A–2, the intersecting heavy metal grid lines act as individual fuses, which can "blow" individually, while still permitting function of the remainder of the microwave-absorbing pattern. This mechanism apparently operates as follows. Some of the grid lines are exposed to abnormally high levels of microwave energy due to "hot spots" within a microwave oven. These grid lines rapidly heat up, which rapidly heats the adjacent polymeric laminate. The laminate can exceed its extrusion temperature causing it to quickly shrink and break the adjacent metallic grid line. This isolated break stops the heating process of that isolated portion of the grid, but does not stop the remainder of the grid from undergoing resistive heating, thereby avoiding further damage and/or arcing in the microwave-absorbing layer.

Figure 4:
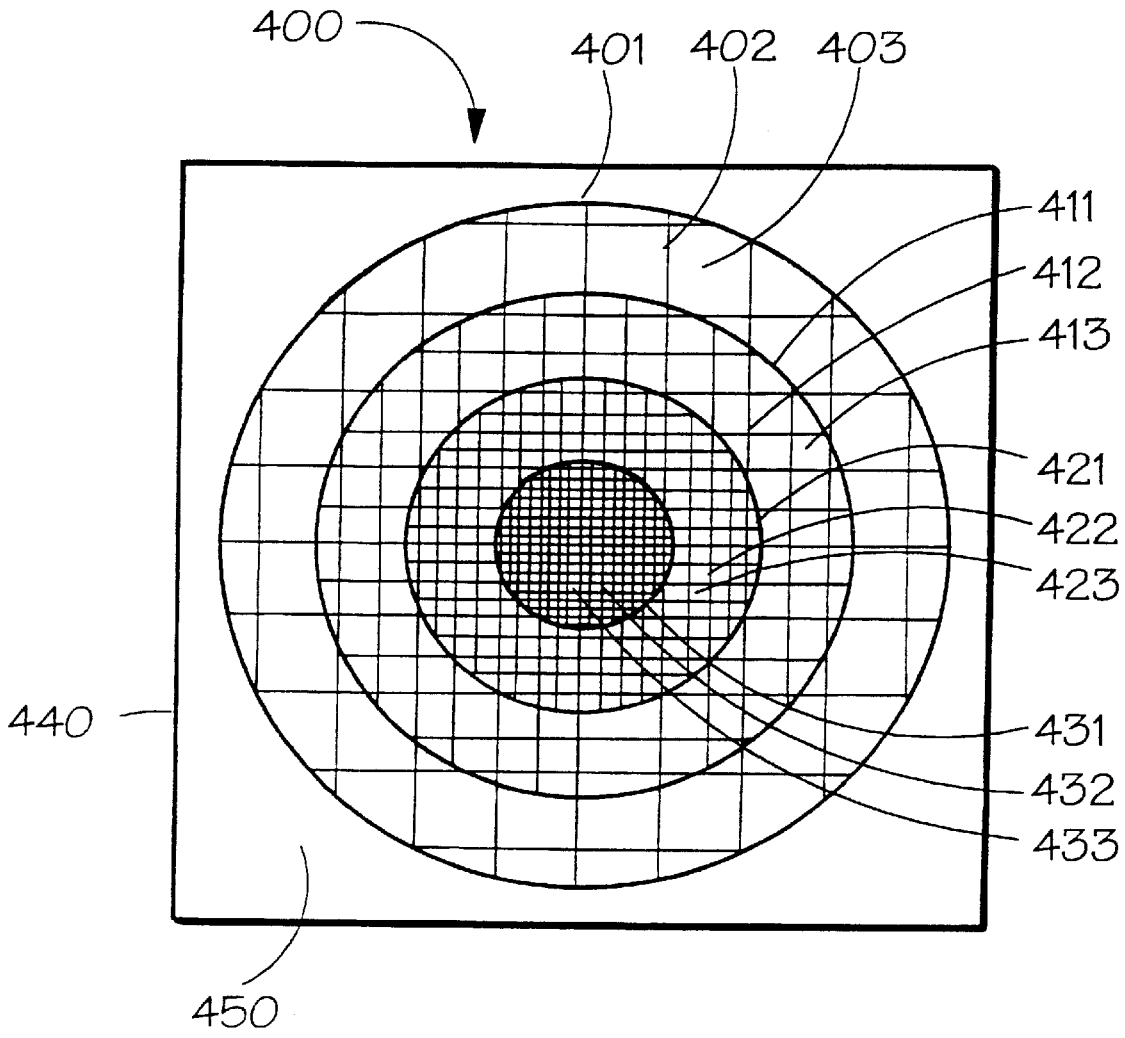
FIG. 4 is a plan view of another embodiment of a heavy-metal susceptor of the invention.

A further embodiment of a heavy-metal laminated susceptor 400 according to the principles of the present invention is illustrated in FIG. 4. The susceptor 400 may be fabricated using suitable methods such as those described with regard to previous embodiments of the present invention. The susceptor 400 comprises four isolated microwave-absorbing regions of heavy-metal film in a pattern of three concentric ring regions 401, 411, and 421 surrounding a circular center region 431. The four microwave-absorbing regions 401, 411, 421, and 431 are disposed, for example, contiguous with an electrically insulating polyester barrier layer 450 and, optionally, an electrically insulating paperboard structural backing layer 440. Each microwave-absorbing region 401, 411, 421, and 431 possesses a subpattern. Any suitable subpattern may be utilized. Square non-conductive regions 403, 413, 423, and 433 separated by aluminum grid lines 402, 412, 422, and 432 are illustrated by way of example. Further, the microwave-absorbing regions 401, 411, 421, and 431 have different effective electrical sheet resistances and different percentages of open area to provide a greater amount of heating in the center region 431 and decreasing amounts of heating in each successive concentric region 421, 411, and 401. For example, the center of the susceptor 431 may be 80% line screened, which is decreased in the radially outward direction such that the radially outer subpattern is 40% line screened. The susceptor 400 is thus able to provide an even bake to a circular-shaped food product, such as a frozen pizza, that ordinarily possesses a tendency to be overcooked near the edge and undercooked near the center.

Figure 5A:
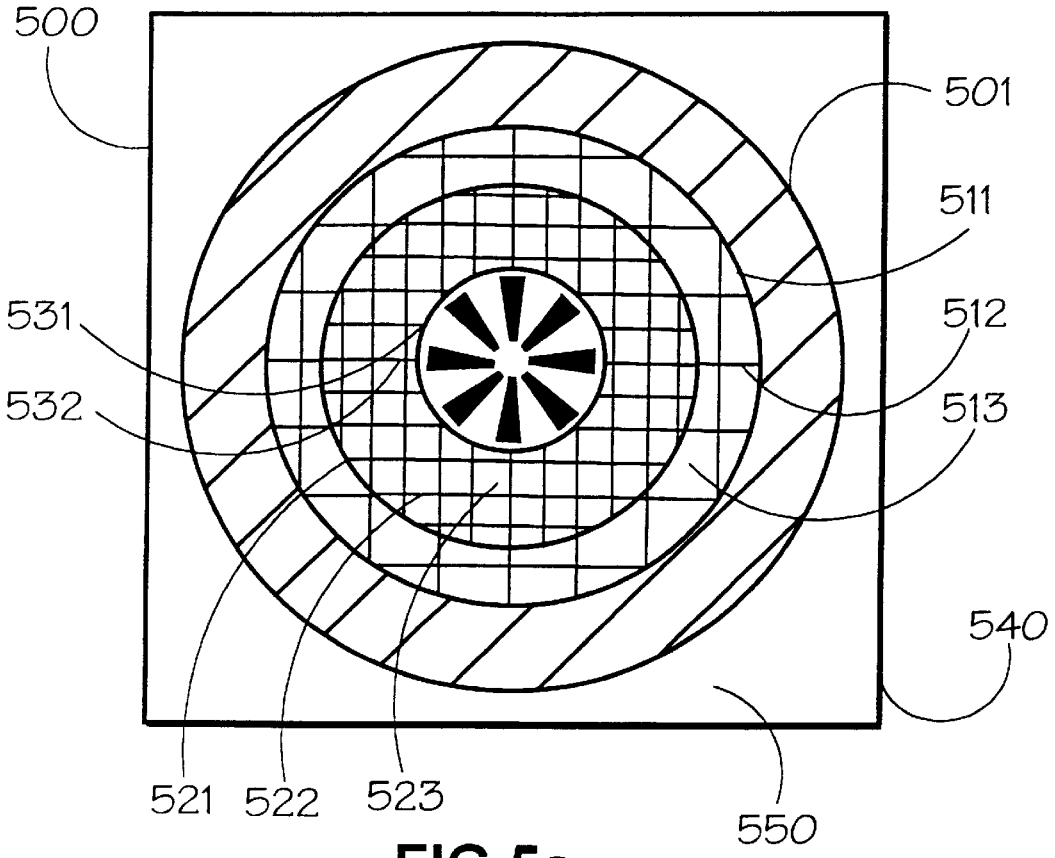
FIG. 5A is a plan view of a further heavy-metal susceptor having absorbing, shielding, and intensifying regions of the invention.

A further embodiment of a heavy-metal laminated susceptor 500 according to the principles of the present invention is illustrated in FIG. 5A. The susceptor 500 may be fabricated using suitable methods such as those described with regard to previous embodiments of the present invention.

The susceptor 500 comprises two concentric ring-shaped microwave-absorbing regions 511 and 521 surrounding a circular microwave-intensifying region 531. The susceptor 500 further comprises a concentric ring-shaped microwave-shielding region 501 surrounding the microwave-absorbing regions 511 and 521. The microwave-absorbing regions 511 and 521, the microwave-intensifying region 531, and microwave-shielding region 501 have the same thickness and can, optionally, all originate from the same heavy-metal aluminum film. The regions 501, 521, and 531 can be disposed contiguous with an electrically insulating polyester barrier layer 550 and, optionally, with an electrically insulating paperboard structural backing layer 540.

The microwave-absorbing regions 511 and 521 possess subpatterns of non-conductive regions 513 and 523 separated by aluminum grid lines 512 and 522 and are designed to provide greater heating nearer to the center of the susceptor 500. The microwave-intensifying region 531 is comprised of a pattern of eight radial aluminum spokes 532, narrower near the center, in a pinwheel arrangement designed to intensify microwave radiation near the center of an intended circular-shaped food product. The spokes 532 are formed of continuous aluminum film and need not possess subpatterns. Likewise, the microwave-shielding region 501 can be formed of continuous aluminum film and does not require a subpattern. Alternatively, shielding region 501 may be patterned in a suitable manner so long as the resistivity of the patterned region remains within the shielding range. The microwave-shielding region 501 can be designed to reflect a portion of the incident microwave energy from the outer edge of the intended food product. The susceptor 500 is thus designed to provide an even bake to a circularly-shaped food product that ordinarily possesses a tendency to be overcooked near the edge and undercooked near the center.

Figure 5B:
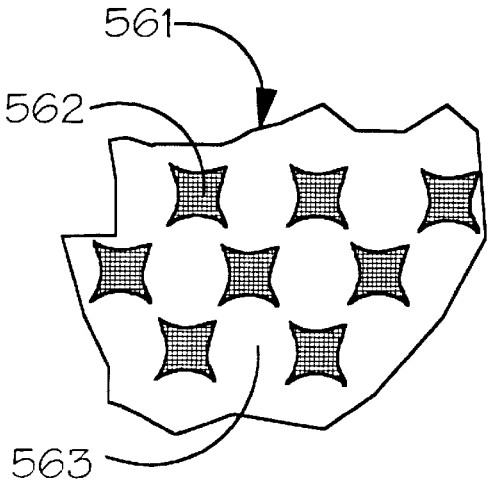
FIG. 5B is a plan view of an alternate heavy-metal microwave-shielding region provided with a subpattern of metal islands in a further embodiment of the invention.

As noted above, the microwave-shielding region 501 may be provided with a subpattern to control the reflectivity of that region. FIG. 5B illustrates a plan view of an alternate microwave shielding region 561 in the same shape as the shielding region 501 illustrated in FIG. 5A but having a subpattern of isolated metal islands 562 separated by spaces 563. The subpattern of metal islands 562 in this variation may be provided, for example, by printing droplets of etchant during the fabrication of the susceptor 500 onto the metallized polyester barrier layer 550 such that the droplets partially overlap, creating separated metal islands 562 upon etching and rinsing.

Figure 5C:
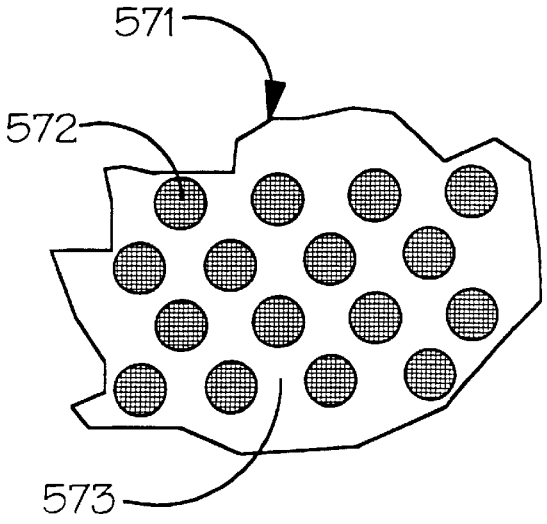
FIG. 5C is a plan view of a portion of another alternate heavy-metal microwave-shielding region provided with an alternative subpattern of metal islands in a further embodiment of the invention.

Alternatively, FIG. 5C illustrates a plan view of another microwave shielding region 571 in the same shape as the shielding region 501 illustrated in FIG. 5A but having a different subpattern of isolated metal islands 572 separated by spaces 573. In this variation, the subpattern of metal islands 572 may be provided by printing droplets of etch-resistant masking material (etch-resistant ink) onto the metallized polyester barrier layer 550 to define the metal islands 572 during the fabrication of the susceptor 500. In addition, the shapes and subpatterns of microwave-absorbing regions 511 and 521 and the pattern of the microwave-intensifying region 531 may be defined by printing etch-resistant ink onto the metallized polyester barrier layer 550 during the same printing step. The metallized polyester barrier layer 550 is then washed in an etchant, such as sodium hydroxide (NaOH), removing the metal from regions not protected by the etch-resistant ink. After rinsing and drying, the metallized polyester barrier layer 550 may optionally be laminated to the structural backing layer 540.

Figure 6:
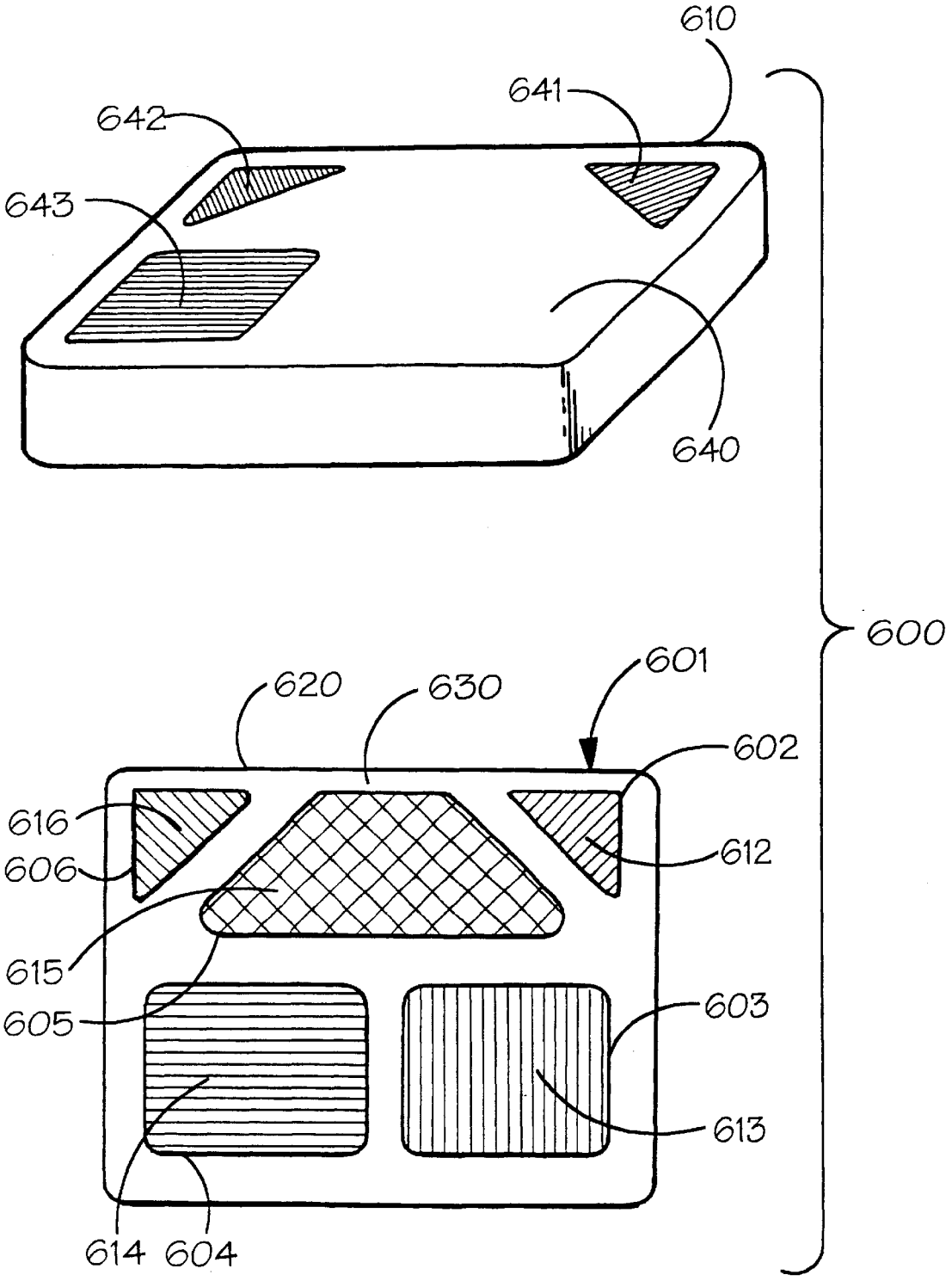
FIG. 6 is a plan/perspective view of a further embodiment in the form of a microwave food package of the present invention.

A further embodiment of the present invention is illustrated in FIG. 6 illustrating a microwave food package 600 which incorporates a heavy metal laminate formed consistent with the present invention comprising a food tray 601 and an outer enclosure 610. The tray 601 possesses five recessed regions 602, 603, 604, 605, and 606 having heavy-metal aluminum microwave-absorbing regions 612, 613, 614, 615, and 616 patterned as taught by the present invention to provide different heating characteristics positioned at the bases of the recessed regions 602, 603, 604, 605, and 606. Such an arrangement may be advantageous in applications such as T.V. dinner packages which contain different food items which require different levels of heating. For instance, T.V. dinners often contain meat in one compartment, vegetables in another, and dessert in yet another compartment. Therefore, an effective cooking package can be manufactured by disposing a heavy-metal microwave-absorbing layer patterned to have a relatively high effective sheet resistance (to generate more heat) in a compartment adapted to house the meat item, and disposing a heavy-metal microwave-absorbing layer patterned to have a relatively low effective sheet resistance (to generate less heat) in a compartment adapted to house the dessert item, etc. The recessed regions 602, 603, 604, 605, and 606 of the tray 601 are produced with a conventional stamping apparatus from a laminated structure comprising the microwave-absorbing regions 612, 613, 614, 615, and 616 disposed, for example, between a polymer barrier layer 630 and a paperboard structural backing layer 620.

The tray 601 can optionally be used in conjunction with an outer enclosure 610 which is also a laminated structure comprising three heavy-metal aluminum microwave-shielding regions 641, 642, and 643 disposed contiguous with a polymer barrier layer (not shown), and optionally a food-grade paperboard structural backing layer 640, produced using previously discussed techniques. The outer enclosure 610 has been cut, folded, and bonded to final shape with food-grade adhesive using conventional packaging techniques. The positions of the microwave-shielding regions 641, 642, and 643 correspond to recessed regions 602, 606, and 604 of the tray 601 for which it is desired that a portion of the incident microwave energy be shielded. The shielding regions are formed as previously described—that is, as a continuous film or by patterning a heavy-metal film to produce an effective sheet resistance falling within the shielding range.

While the tray 601 and outer cover 610 have been illustrated as two separate members, it is well within the scope of the present invention to unite the two to form a unitary one-piece container with an attached lower member.

Regardless of whether the tray 601 and outer cover 610 are separate or integrated, an important benefit of the present invention is that all of the heavy-metal patterns and areas may be disposed on the same substrate during production, and could be formed from the same stock polymer/metal laminate since the microwave-absorbing regions and the microwave-shielding regions have substantially the same thickness. Therefore, one could provide the required patterns on the polymer/metal laminate, then effect the appropriate stamping, cutting, and/or folding steps to form a container which has at least both microwave-absorbing and microwave-shielding areas. This enables significant advantages compared to prior art constructions which incorporate both microwave-absorbing and microwave-shielding into a food package. In the prior art, the microwave-shielding layers are thicker than the microwave-absorbing layers, thereby necessitating formation of a laminate having metal coatings of different thicknesses.

It is also within the scope of the present invention to form the microwave absorbing regions and/or microwave shielding regions as separate components that are attached to or otherwise cooperate with the food package or laminate to perform as desired.

Figure 7:
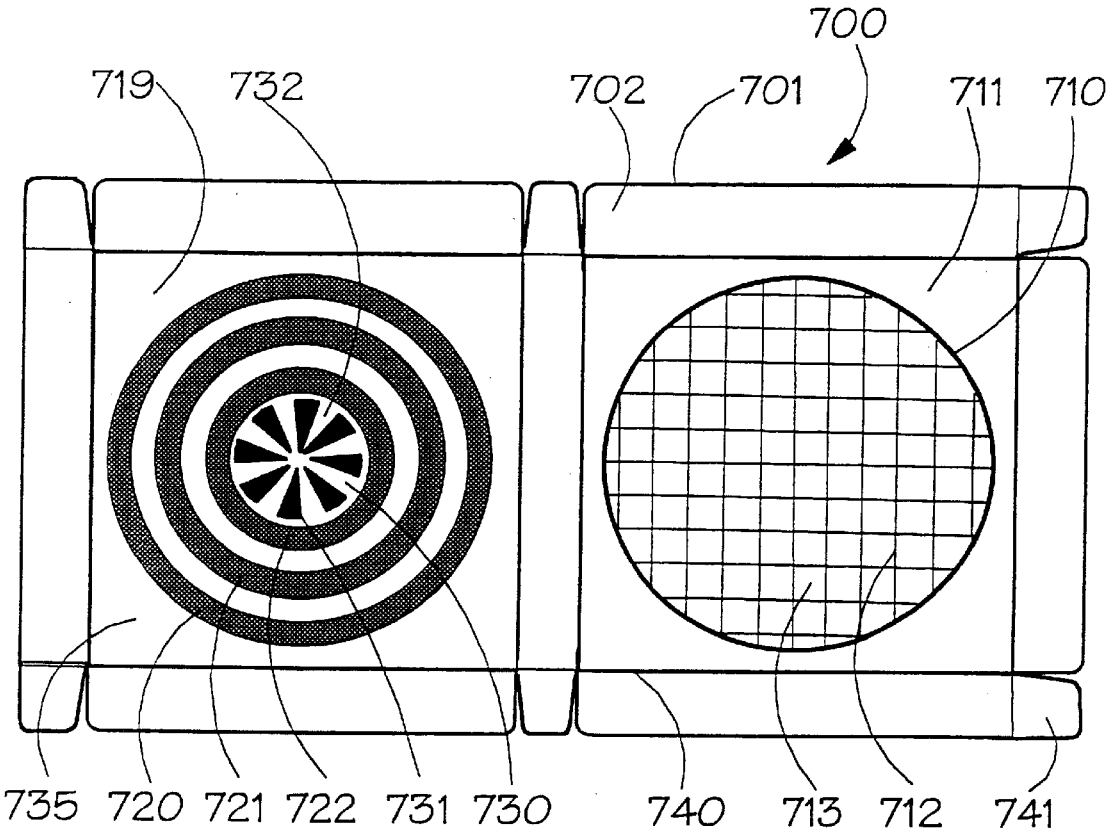
FIG. 7 is a plan view of an unassembled microwave food package formed according to a further embodiment of the invention including a heavy-metal susceptor and a heavy-metal shield/intensifier on an opposing surface.

A further embodiment of the present invention in the form of an unassembled microwave food package 700 formed according to the principles of the present invention is illustrated in plan view in FIG. 7. The unassembled food package 700 comprises a heavy-metal microwave-absorbing region 710, a microwave-intensifying region 730 of heavy-metal radial spokes 731 separated by spaces 732, and three microwave-shielding regions 720, 721, and 722 in the form of heavy-metal concentric rings disposed contiguous with a substrate such as a polymer barrier layer 702, and optionally laminated together with a structural backing layer 701. The metallization and patterning these regions are accomplished using methods previously discussed herein.

As discussed in connection with the previous embodiment, the patterned heavy-metal regions can all be formed on the same side of a single substrate, or from a single stock metal/polymer laminate, since these regions all have the same thicknesses.

The heavy-metal microwave-absorbing region 710 can comprise any suitable absorbing pattern such as a grid of heavy-metal lines 712 disposed perpendicularly to each other. Square non-conductive regions 713 disposed in a pattern separate the grid lines 712. The microwave-absorbing region 710 can be disposed in the overall shape of a circle in one area 711 of the structural backing layer 701. In addition, the three microwave-shielding regions 720, 721, and 722 and the microwave-intensifying region 730 are disposed in a separate area 719 of the structural backing layer 701 such that the shielding and intensifying regions 720, 721, 722 and 730 oppose the microwave absorbing area 710 when the package is folded and/or assembled.

The food package 700 may further comprise a series of stamped folding lines 740 and joining tabs 741 that allow the package to be folded and bonded using food grade adhesive into its final assembled shape. The cutting, stamping, folding, and bonding of the food package 700 are accomplished using conventional packaging techniques after the microwave-absorbing region 710, the microwave-intensifying region 730, and the microwave-shielding regions 720, 721, and 722 have been prepared and after lamination of the structural backing layer 701 and the polymer barrier layer 702.

When assembled, an intended food product (not shown), such as a frozen pizza, may be placed inside the assembled package (not shown) upon the microwave-absorbing region 710. Region 719 is folded over such that the microwave-shielding regions 720, 721, and 722 at least partially overlap and shield the outer edge of both the heavy-metal microwave-absorbing region 710 and the intended food product from microwave energy. In addition, the intensifying region 730 of radial spokes 731 partially focuses microwave energy near the center of the food product. In other words, microwave energy incident upon the top of the assembled package 700 is first modified by shielding and intensifying regions 720, 721, 722 and 730 prior to reaching the microwave absorbing region 710. The combined effect is to provide an even bake for a circularly-shaped food product that ordinarily possesses a tendency to be overcooked near the edge and undercooked near the center.

The microwave-shielding regions 720, 721, and 722 may comprise continuous heavy-metal aluminum film. Alternatively, it should be understood that these regions may also be provided with subpatterns to control reflectivity as discussed in the previous embodiments.

It is also within the scope of the present invention to form the microwave absorbing regions and/or microwave shielding regions as separate components that are attached or otherwise cooperate with the food package or laminate to perform as desired.

In the remaining embodiments described hereafter, the disclosed patterned heavy-metal layers can constitute either a susceptor "underlay" or a shield.

Figure 14A:
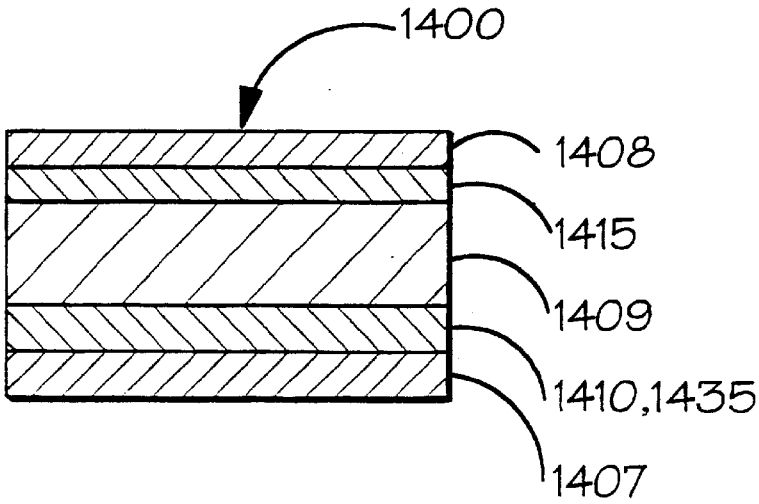
FIG. 14A is a cross-sectional view of a microwaveable laminate having flip-up sides in a farther embodiment of the present invention.

An "underlay" according to the present invention is intended to mean a patterned heavy-metal layer incorporated into a laminate or cooperating with a laminate, the laminate including a microwave absorbing layer or susceptor layer (see, e.g., FIG. 14A). More particularly, the laminate has a first side configured to have a food product disposed thereon, and an opposing second side. Preferably, the underlay is disposed on the second side of the laminate. More preferably, the underlay has a heavy-metal pattern disposed on the second side and is configured to be more remote from the source of microwave energy during cooking than the first side of the laminate. When functioning as a shield, the heavy metal layer is incorporated into at least a portion of a laminate which does not include a susceptor layer or otherwise cooperates with a laminate or laminate portion that lacks a susceptor layer.

One such susceptor underlay or shield 800 can comprise, for example, a symmetrical heavy-metal patterned region 810 of circular overall shape approximately seven inches in diameter incorporated into a laminate, and can be disposed between a first layer 808 substantially transparent to microwave radiation having an electrically insulating surface (not shown) and optionally, a second layer 809 substantially transparent to microwave radiation having an electrically insulating surface (not shown).

The heavy-metal patterned region 810 is now described. Eight isolated spokes 804 extend radially from the center of the patterned region 810. Neighboring spokes 804 are disposed substantially at an angle of 45 degrees relative to each other as measured at the center of the patterned region 810. Between each pair of neighboring spokes 804 is an isolated triangular region 806 of close-packed hexagons 807. Each triangular region 806 extends radially from the center of the patterned region 810. The separation between neighboring hexagons 807 in a given triangular region 806 is approximately 0.03 inch. Adjacent spokes 804 and triangular regions 806 are separated by spaces 805. The collection of spokes 804 and triangular regions 806 forms an overall circular shape centered at the center of the patterned region 810.

Surrounding the collection of spokes 804 and hexagons 807 is a concentric first ring 803 of substantially triangular-shaped elements 815. The first ring 803 is separated from the triangular regions 806 by a gap 811. The triangular-shaped elements 815 of the first ring 803 are disposed in contact with each other with their narrow ends directed toward the center of the heavy-metal patterned region 810. Surrounding the first ring 803 of triangularly-shaped elements 815 is a concentric second ring 802 of triangular-shaped elements 815 disposed in the same manner as those for the first ring 803. The first ring 803 and the second ring 802 are separated by a gap 812.

The susceptor underlay or shield 800, preferably having a second layer as described above, may be placed under a conventional or heavy-metal microwave susceptor as a separate device or, alternatively, may be laminated to an electrically insulating surface of a heavy-metal or conventional microwave susceptor laminate using methods previously taught herein.

The overall effect of the heavy-metal susceptor underlay or shield 800 is to partially shield or modify the behavior of a susceptor layer at the edge region of a microwave susceptor and an intended food product (not shown) disposed above the susceptor underlay 800, to focus microwave energy toward the center of the food product, and to conduct heat from an outer region of the microwave susceptor toward the center region of the susceptor. In this manner, an even bake is provided for a food product, such as a frozen pizza, that ordinarily possesses a tendency to be overcooked near its edge and undercooked near its center.

It should be noted that, consistent with the principles of the present invention, placing a heavy-metal conductive layer in close proximity to a susceptor layer can be used to moderate, the susceptor's ability to generate heat, even to the point of substantially eliminating the susceptor's ability to heat if the heavy-metal layer is sufficiently close to susceptor layer and highly conductive. Therefore one can use the heavy-metal conductive underlay, and its positioning to tune the susceptor to generate less heat overall or at certain locations, and thereby affect the cooking behavior of the susceptor. It is to be understood that the alternative structures subsequently described herein can function and be used in the same manner described above.

Figure 9:
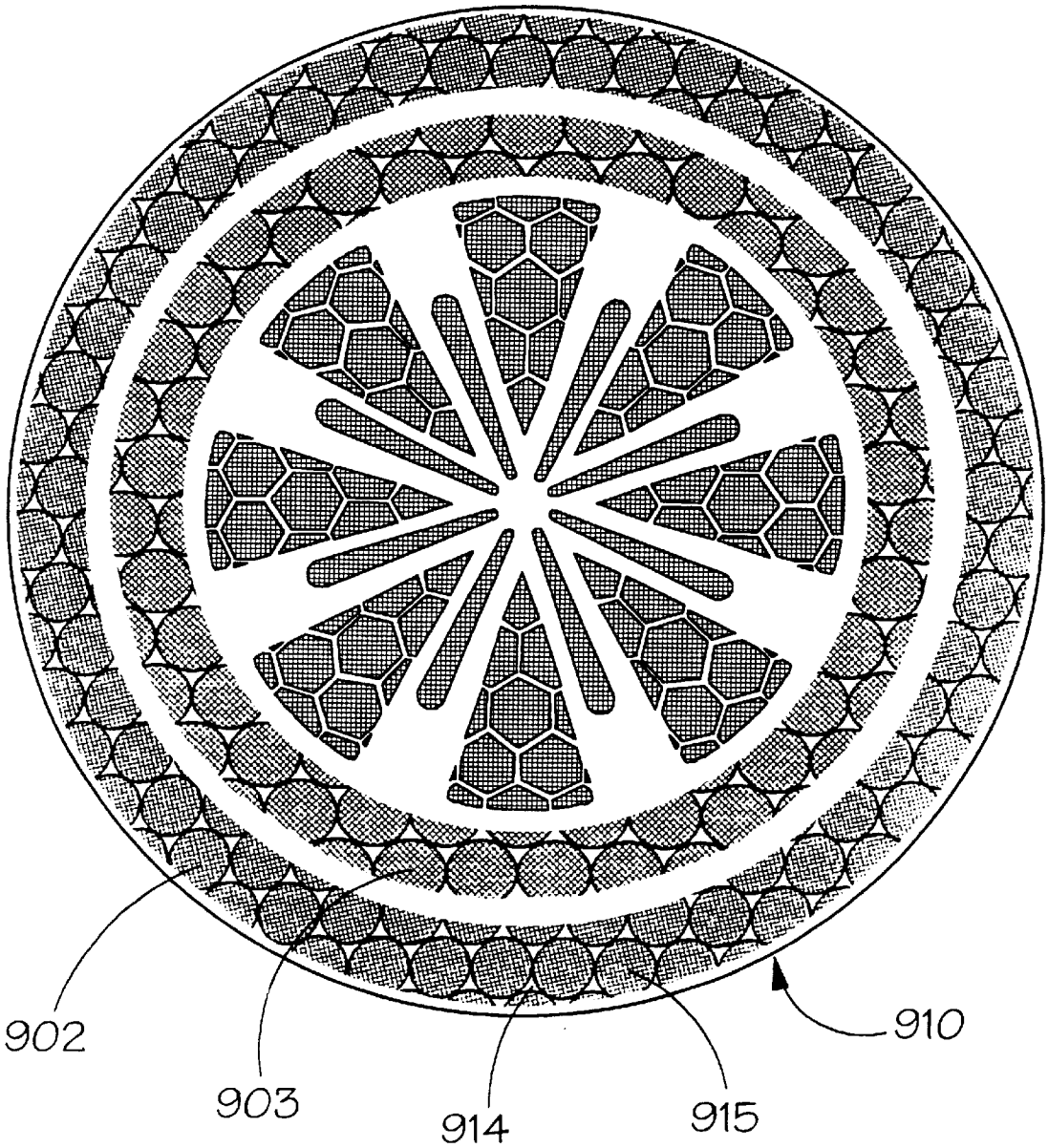
FIG. 9 is a plan view of a further embodiment of a heavy-metal patterned region.

A variation of a susceptor underlay or shield according to a further embodiment of the present invention is illustrated in plan view in FIG. 9 for an alternate heavy-metal patterned region 910. In this view, only the heavy-metal patterned region 910 of the underlay or shield is shown, but it should be understood that the heavy-metal patterned region 910 can also be disposed on a first layer substantially transparent to microwave radiation and may optionally be accompanied by a second layer substantially transparent to microwave radiation as described in the above embodiment. This possible incorporation into a laminate applies to the additional variations of the susceptor underlay or shielding patterns described below.

Figure 8:
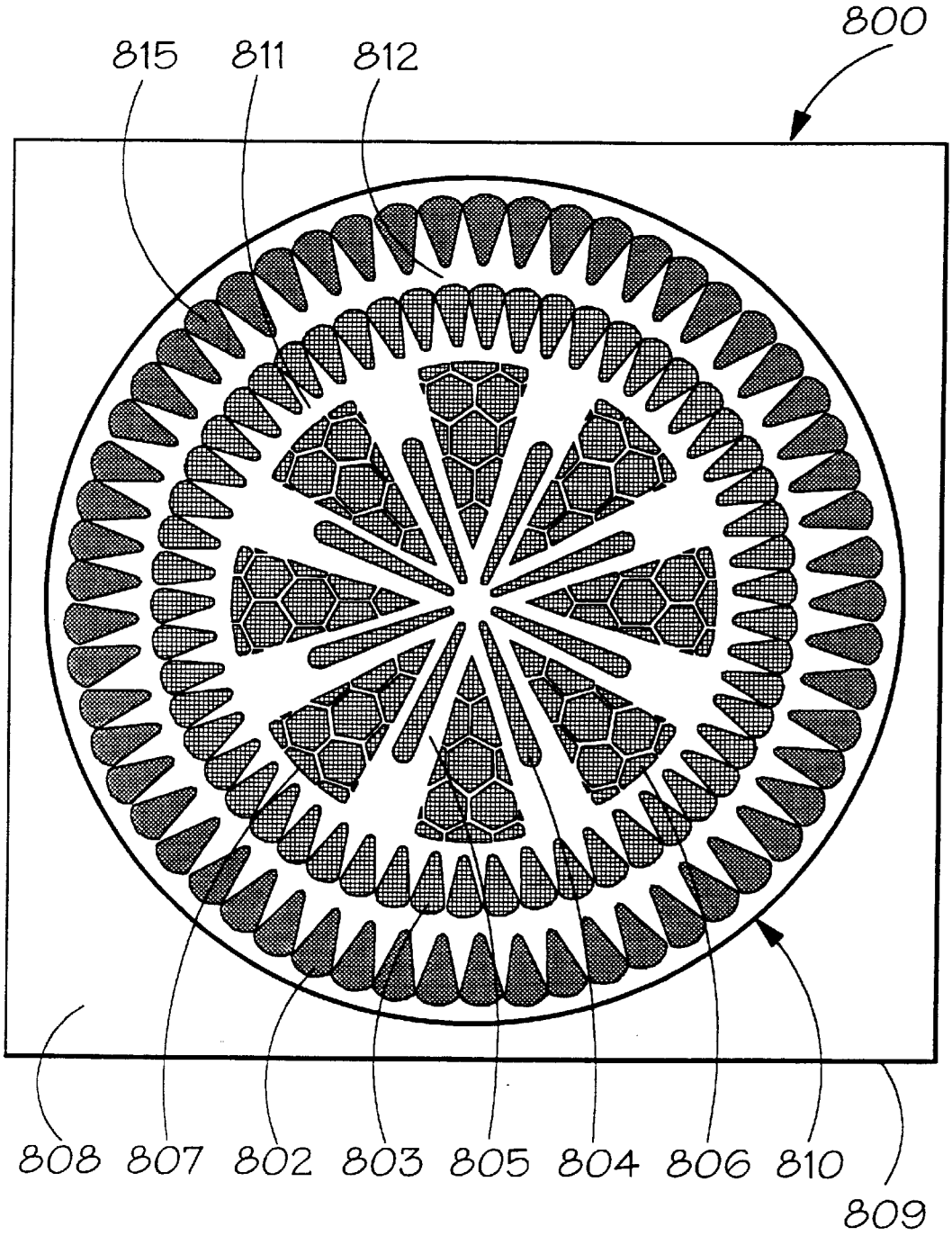
FIG. 8 is a plan view of a heavy-metal patterned region in a further embodiment of the present invention.

The heavy-metal patterned region 910 illustrated in FIG. 9 is similar to the heavy-metal patterned region 810 illustrated in FIG. 8, and common characteristics are not recited here. The heavy-metal patterned region 910 differs from the patterned region 810 in that the concentric rings 902 and 903 illustrated in FIG. 9 corresponding to concentric rings 802 and 803 in FIG. 8 but comprise an array of circular elements 915 rather than a plurality of triangular-shaped elements 815. The circular elements 915 are approximately 0.375 inch in diameter and are separated from each other by approximately 0.015 inch at their closest points. Between the circular elements 915 are open triangular-shaped voids 914.

Figure 10:
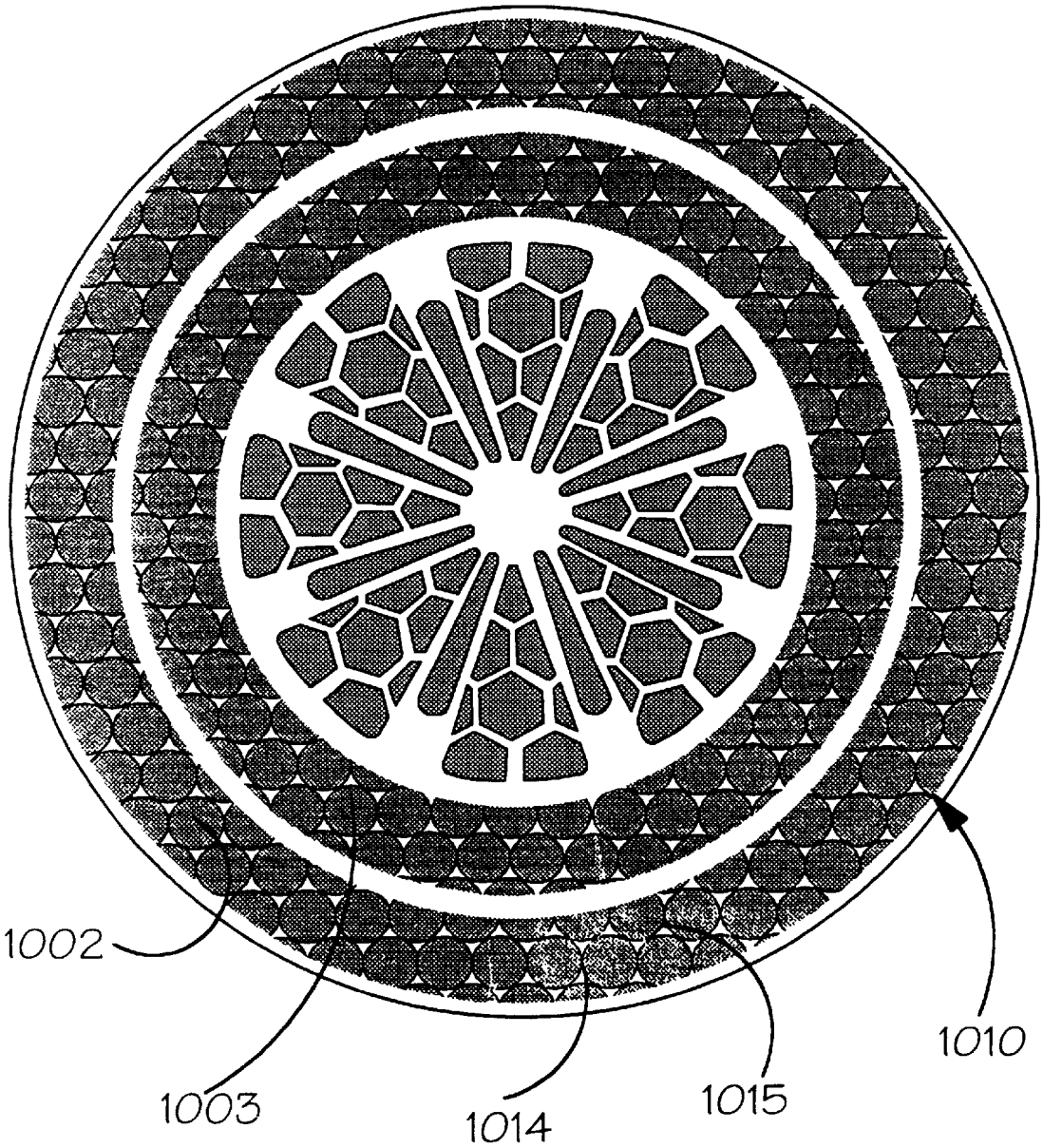
FIG. 10 is a plan view of a further embodiment of a heavy-metal patterned region.

Another variation of a susceptor underlay or shield according to a further embodiment of the present invention is illustrated in plan view in FIG. 10 and includes another alternate heavy-metal patterned region 1010. The heavy-metal patterned region 1010 illustrated in FIG. 10 is substantially similar to the heavy-metal patterned region 910 illustrated in FIG. 9, and common characteristics are not recited here. The heavy-metal patterned region 1010 differs from the patterned region 910 in that the circular elements 1015 disposed in the concentric rings 1002 and 1003 illustrated in FIG. 10 are in direct contact, unlike the circular elements 915 illustrated in FIG. 9. Further, the triangular voids 1014 illustrated in FIG. 10 are smaller than the corresponding triangular voids 914 illustrated in FIG. 9.

Figure 11:
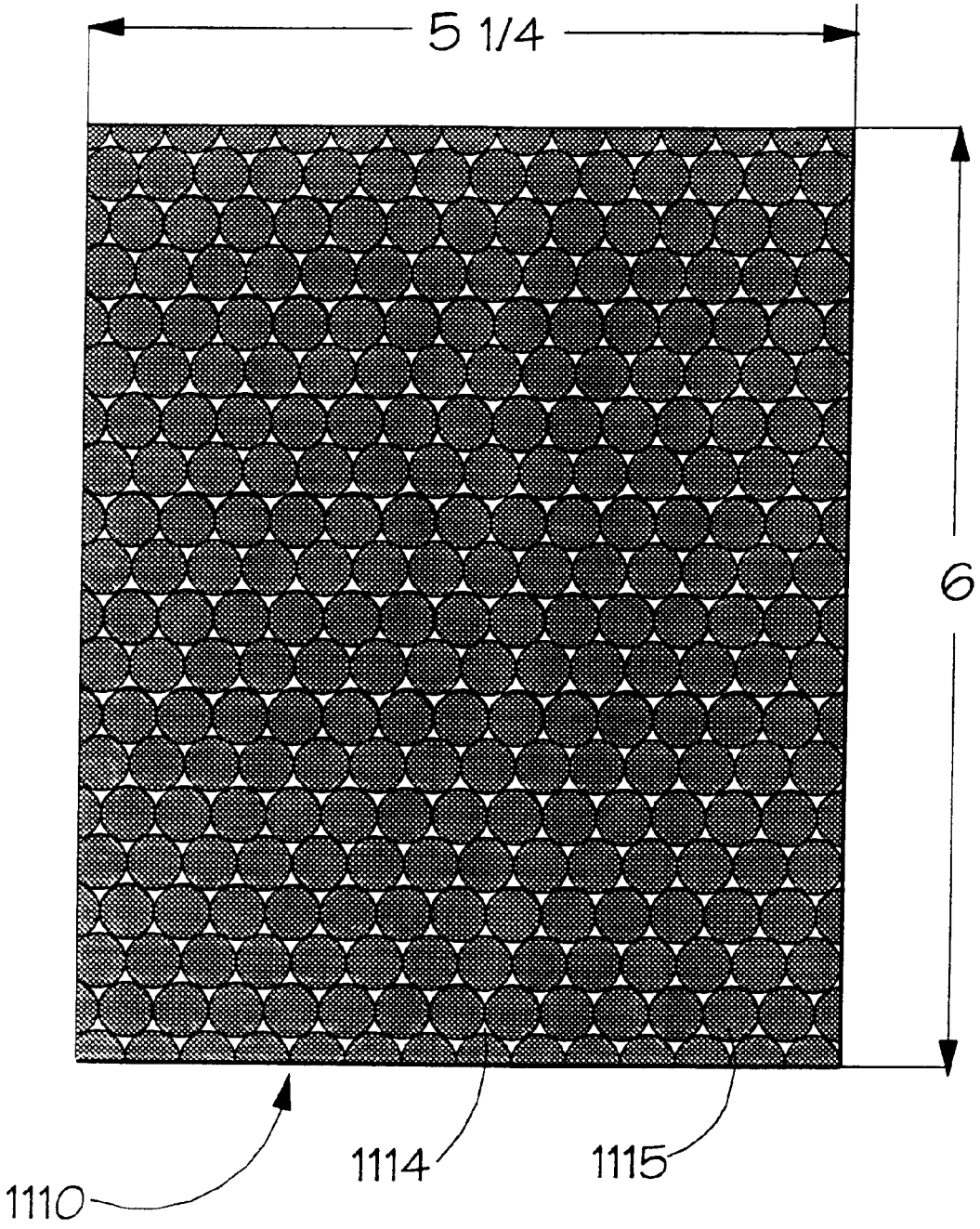
FIG. 11 is a plan view of a further embodiment of a heavy-metal patterned region.

Another variation of a susceptor underlay or shielding pattern 1110 according to a further embodiment of the present invention is illustrated in plan view in FIG. 11. The heavy-metal patterned region 1110 can comprises a rectangular region approximately 5.25 inches wide and 6 inches long having a collection of heavy-metal circular elements 1115 approximately 0.375 inch in diameter. The circular elements 1115 are arranged in a triangular array pattern and are disposed adjacent to interstitial open voids 1114. In addition, the heavy-metal circular elements 1115 are separated at their closest points by approximately 0.015 inch.

Figure 12:
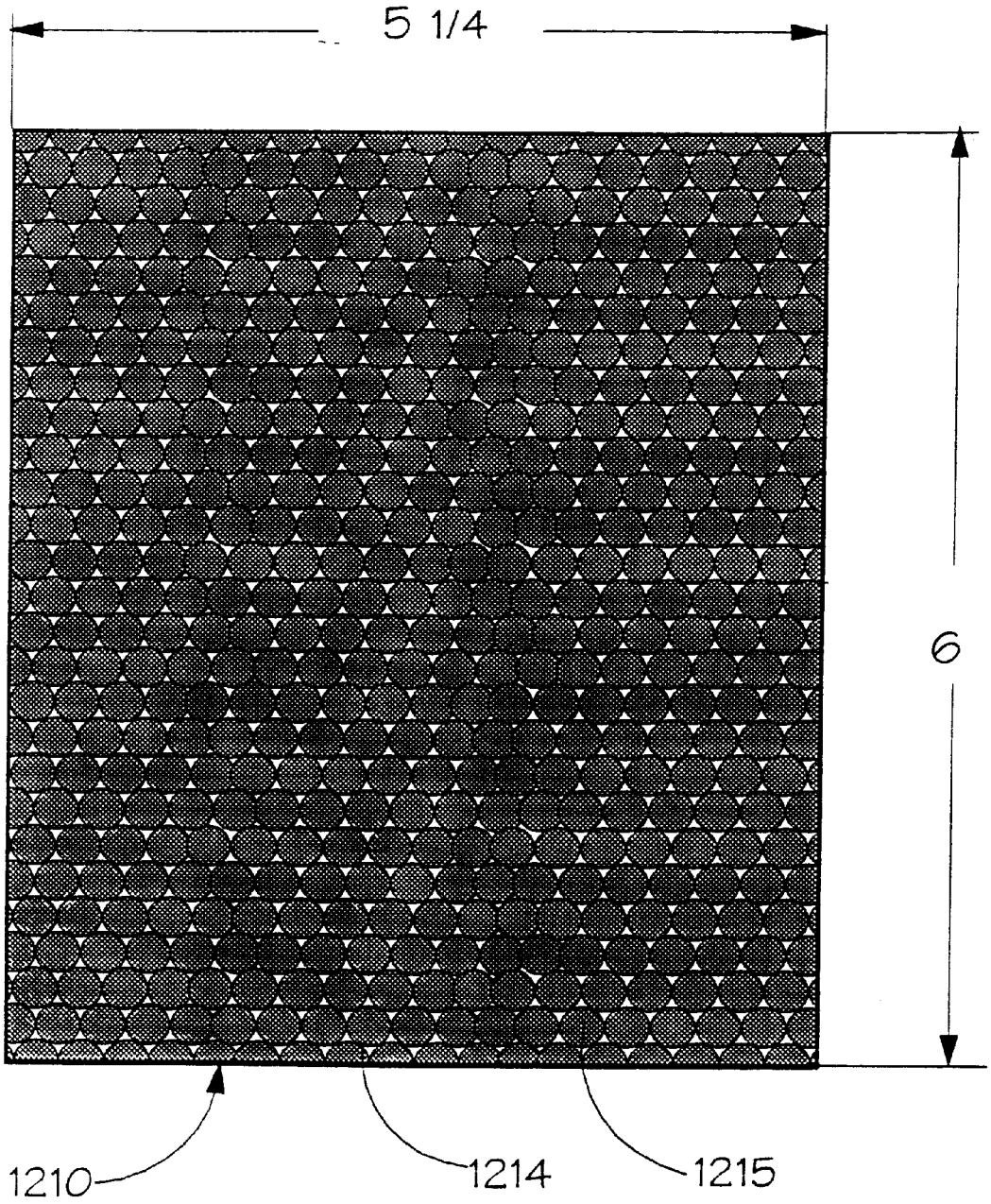
FIG. 12 is a plan view of a further embodiment of a heavy-metal patterned region.

Another variation of a susceptor underlay or shielding pattern 1212 according to a further embodiment of the present invention is illustrated in plan view in FIG. 12. The heavy-metal patterned region 1210 can comprise a rectangular region approximately 5.25 inches wide and 6 inches long having a collection of heavy-metal circular elements 1215 approximately 0.25 inch in diameter. The circular elements 1215 are arranged in a triangular array pattern and are disposed adjacent to interstitial open voids 1214. In addition, the heavy-metal circular elements 1215 are separated at their closest points by approximately 0.015 inch.

Figure 13:
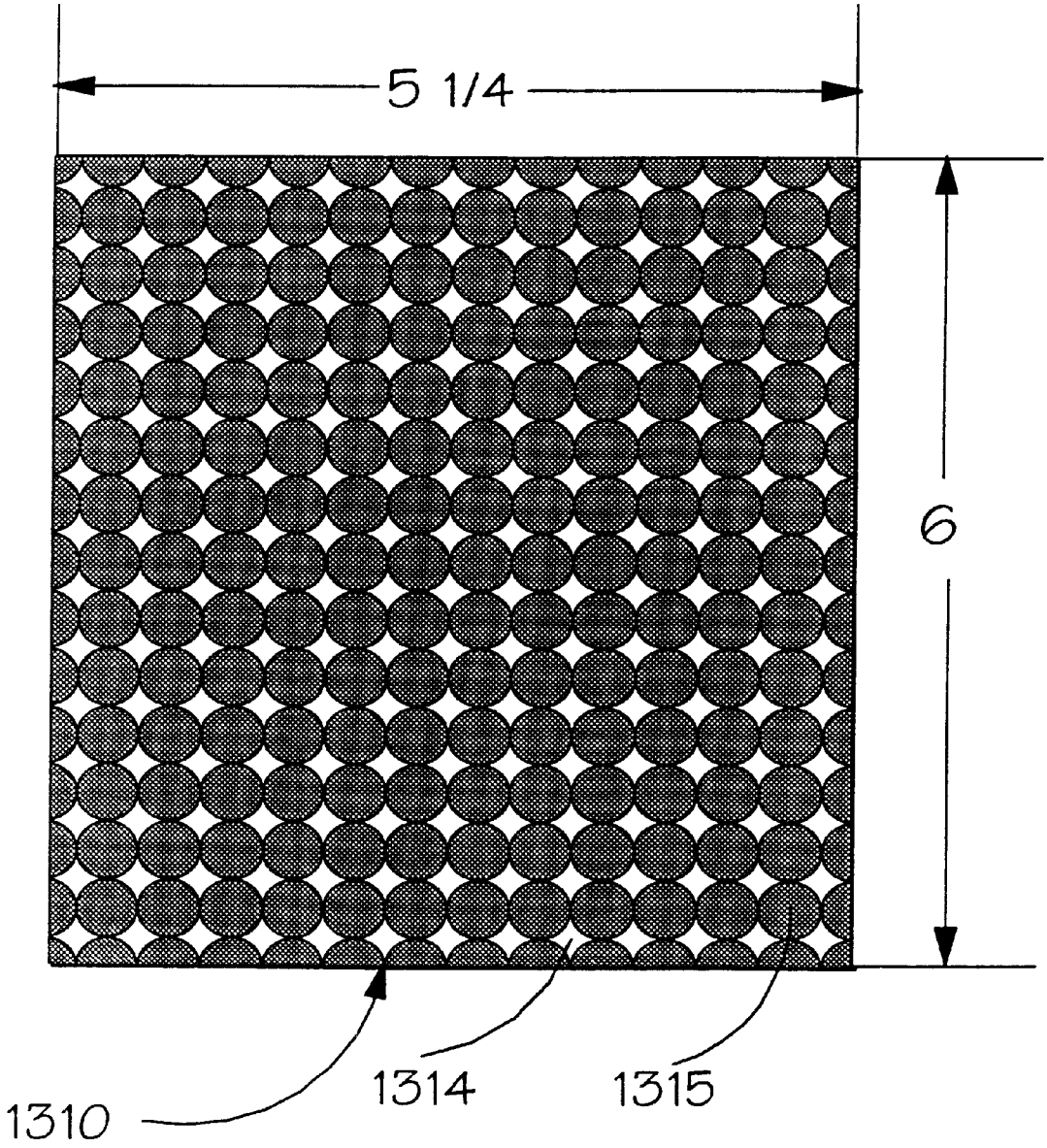
FIG. 13 is a plan view of a further embodiment of a heavy-metal patterned region.

Another variation of a susceptor underlay or shielding pattern 1300 according to a further embodiment of the present invention is illustrated in plan view in FIG. 13 for another alternate heavy-metal patterned region 1310. The heavy-metal patterned region 1310 comprises a rectangular region approximately 5.25 inches wide and 6 inches long having a collection of heavy-metal circular elements 1315 approximately 0.375 inch in diameter. The circular elements 1315 are arranged in a square array pattern and are disposed adjacent to interstitial open voids 1314. In addition, the neighboring heavy-metal circular elements 1315 are in contact.

Figure 14B:
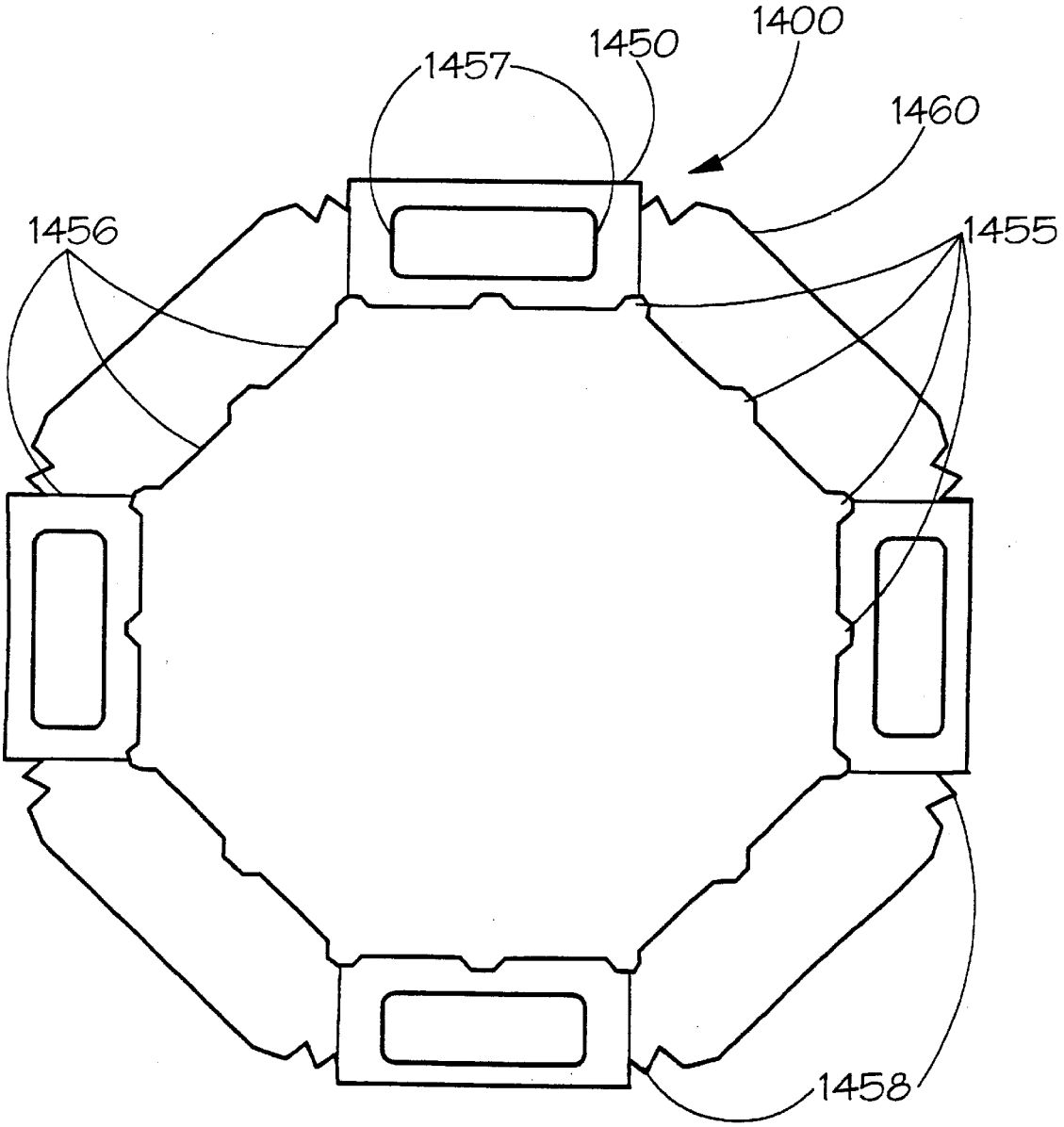
FIG. 14B is a plan view from one side of a microwaveable laminate having flip-up sides in the embodiment of FIG. 14A.
Figure 14C:
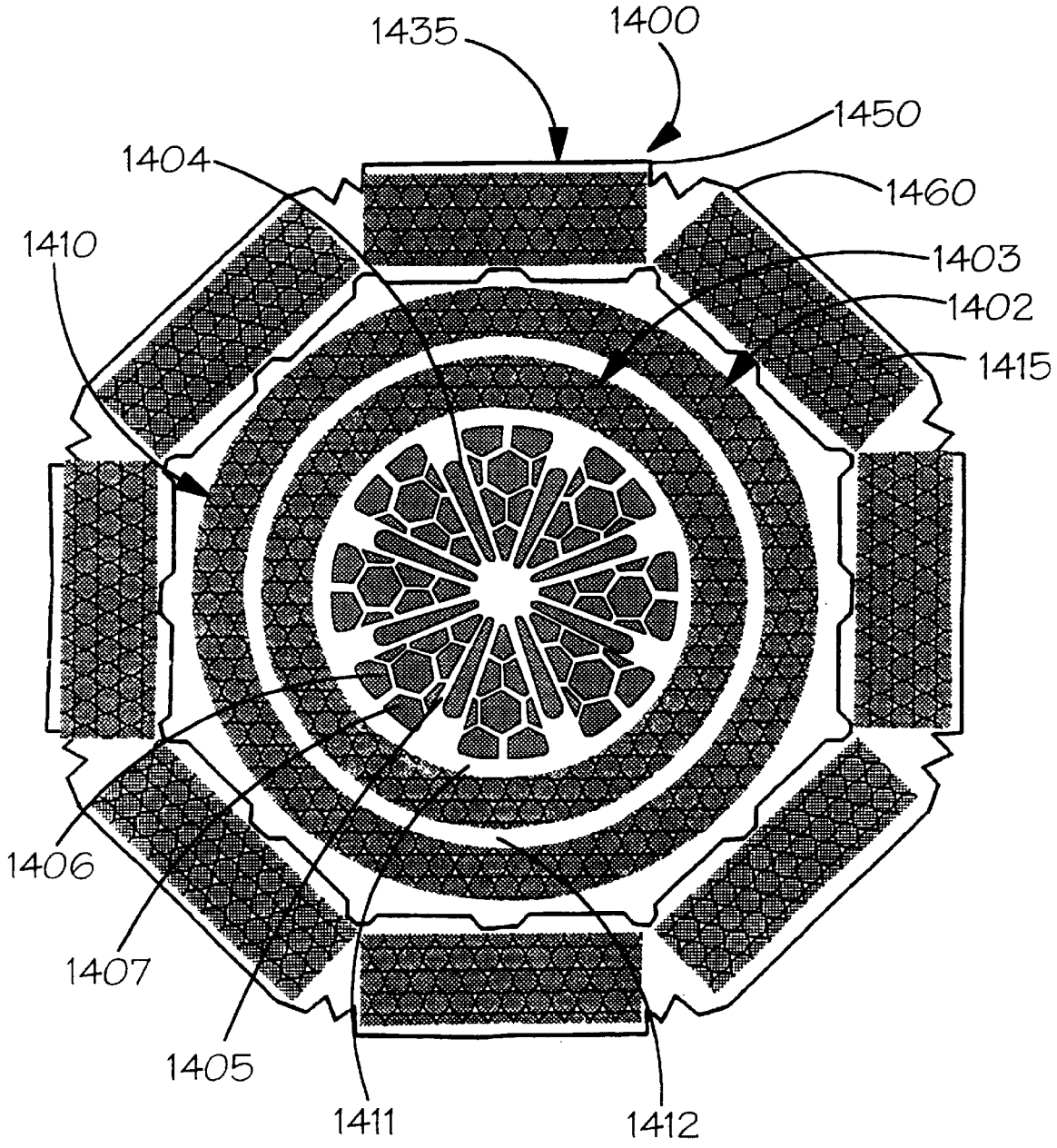
FIG. 14C is a plan view from the opposing side of a microwaveable laminate having flip-up sides of the embodiment of FIG. 14B.

A further embodiment according to the principles of the present invention is a microwaveable laminate 1400 as illustrated in FIGS. 14A, 14B, and 14C having two types of tabs 1450 and 1460, the purpose of which will be explained below. A portion of the laminate 1400 is illustrated in cross-section in FIG. 14A. As indicated in FIG. 14A, the laminate 1400 comprises a microwave-absorbing region 1415 disposed between a paperboard structural backing layer 1409 and a first polyester barrier layer 1408. In this embodiment the microwave-absorbing region may be comprised of a conventional aluminum microwave-absorbing film uniformly disposed on the first polyester barrier layer 1408. Alternatively, the microwave-absorbing region 1415 could be comprised of a heavy-metal film adapted to substantially absorb microwave energy prepared by the methods previously taught herein. The appearance of the laminate 1400 from the side having the first polyester barrier layer 1408 is illustrated in FIG. 14B.

As further illustrated in FIG. 14A, the laminate 1400 also comprises regions of patterned heavy-metal aluminum film 1410 and 1435 disposed between the paperboard structural backing layer 1409 and a second polyester barrier layer 1407.

It is also within the scope of the present invention to form the microwave absorbing regions and/or microwave shielding regions as separate components that are attached or otherwise cooperate with the food package or laminate to perform as desired.

The appearance of the laminate 1400 from the side of the second polyester barrier layer 1407 is illustrated in FIG. 14C.

As illustrated in FIG. 14C, a central patterned region 1410 is surrounded by eight patterned regions 1435. The central region 1410, which is approximately 6.5 inches in diameter, is now described. Eight isolated spokes 1404 extend radially from the center of the patterned region 1410. Neighboring spokes 1404 are disposed substantially at an angle of 45 degrees relative to each other as measured at the center of the patterned region 1410. Between each pair of neighboring spokes 1404 is an isolated triangular region 1406 of close-packed hexagons 1407. Each triangular region 1406 extends radially from the center of the patterned region 1410. The separation between neighboring hexagons 1407 in a given triangular region 1406 is approximately 0.03 inch. Adjacent spokes 1404 and triangular regions 1406 are separated by spaces 1405. The collection of spokes 1404 and triangular regions 1406 forms an overall circular shape centered at the center of the patterned region 1410.

Surrounding the collection of spokes 1404 and hexagons 1407 is a first concentric ring 1403 of substantially circular elements 1415 approximately 0.25 inch in diameter arranged in a triangular array pattern. The first concentric ring 1403 is separated from the triangular regions 1406 by a gap 1411. Neighboring circular elements 1415 of the first ring 1403 are separated at their closest points by approximately 0.015 inch. Surrounding the first ring 1403 of circular elements 1415 is a second concentric ring 1402 of circular elements 1415 disposed in the same manner. The first ring 1403 and the second ring 1402 are separated by a gap 1412.

As further illustrated in FIG. 14C, the central heavy-metal patterned region 1410 is surrounded by eight patterned rectangular regions 1435 of circular elements 1415 disposed on tabs 1450 and 1460. The circular elements 1415 are disposed adjacent to each other in the same manner as that for the concentric rings 1402 and 1403.

As illustrated in FIG. 14B, the laminate 1400 further comprises a series of cuts 1456 completely through the laminate 1400 that allow the tabs 1450 and 1460 to be folded upward, remaining attached to the laminate 1400 by hinge regions 1455 where the laminate 1400 is not cut. In addition, the tabs 1450 further possess cuts 1457 into which the tab-arms 1458 of tabs 1460 may be inserted. As a result the tabs 1450 and 1460 may be folded up substantially perpendicularly to the central portion of the laminate 1400. Further, the tabs may be interlocked together forming a cupped structure (not shown) with the microwave-absorbing regions 1415 of the tabs 1450 and 1460 disposed facing each other. When assembled, a circular food product, such as a frozen pizza, may be placed within the assembled laminate 1400.

The overall effect of the heavy-metal patterned region 1410 is to partially shield the outer edge region of the microwave susceptor and food product (not shown), to focus microwave energy toward the center of the food product, and to conduct heat from the outer region of the microwave laminate 1400 toward the center region of the laminate 1400. Further, the patterned regions 1435 partially shield the corresponding regions of the laminate 1400 and the edge of the food product. In this manner, an even bake is provided for a food product, such as a frozen pizza, that ordinarily possesses a tendency to be overcooked near its edge and undercooked near its center.

Figure 15:
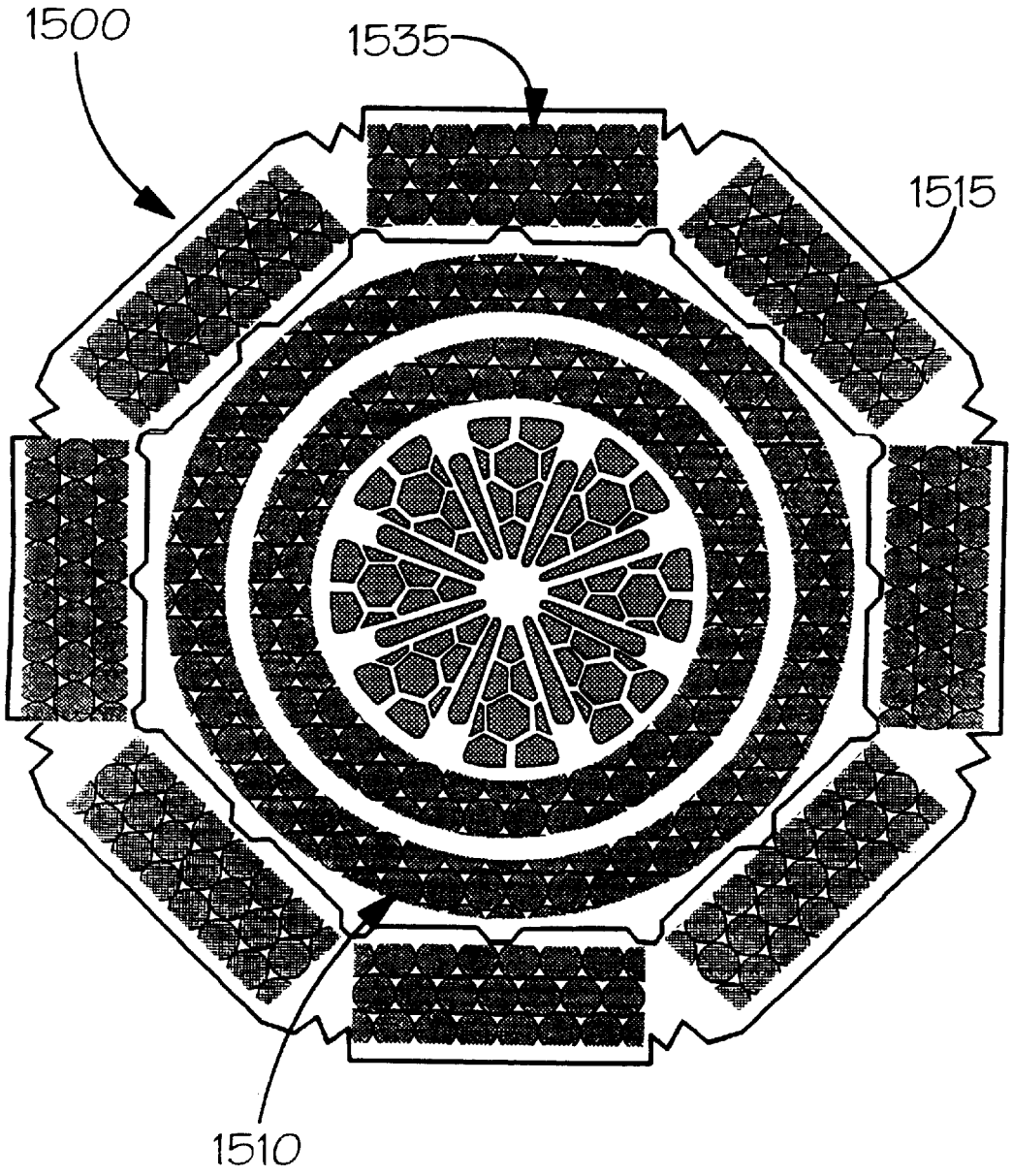
FIG. 15 is a plan view of an alternate heavy-metal patterned region in a further embodiment of the microwaveable laminate of the present invention.

A variation of the laminate 1400 according to a further embodiment of the present invention is illustrated in plan view in FIG. 15. In laminate 1500, the heavy metal pattern 1500 is similar to that disclosed in the previous embodiment.

The patterned regions 1510 and 1535 illustrated in FIG. 15 are substantially similar to the patterned regions 1410 and 1435 illustrated in FIG. 14, and common characteristics are not recited here. The patterned regions 1510 and 1535 differ from the patterned regions 1410 and 1435 in that the circular elements 1515 illustrated in FIG. 15 are approximately 0.375 inch in diameter whereas the circular elements 1415 illustrated in FIG. 14 are approximately 0.25 inch in diameter.

Figure 16:
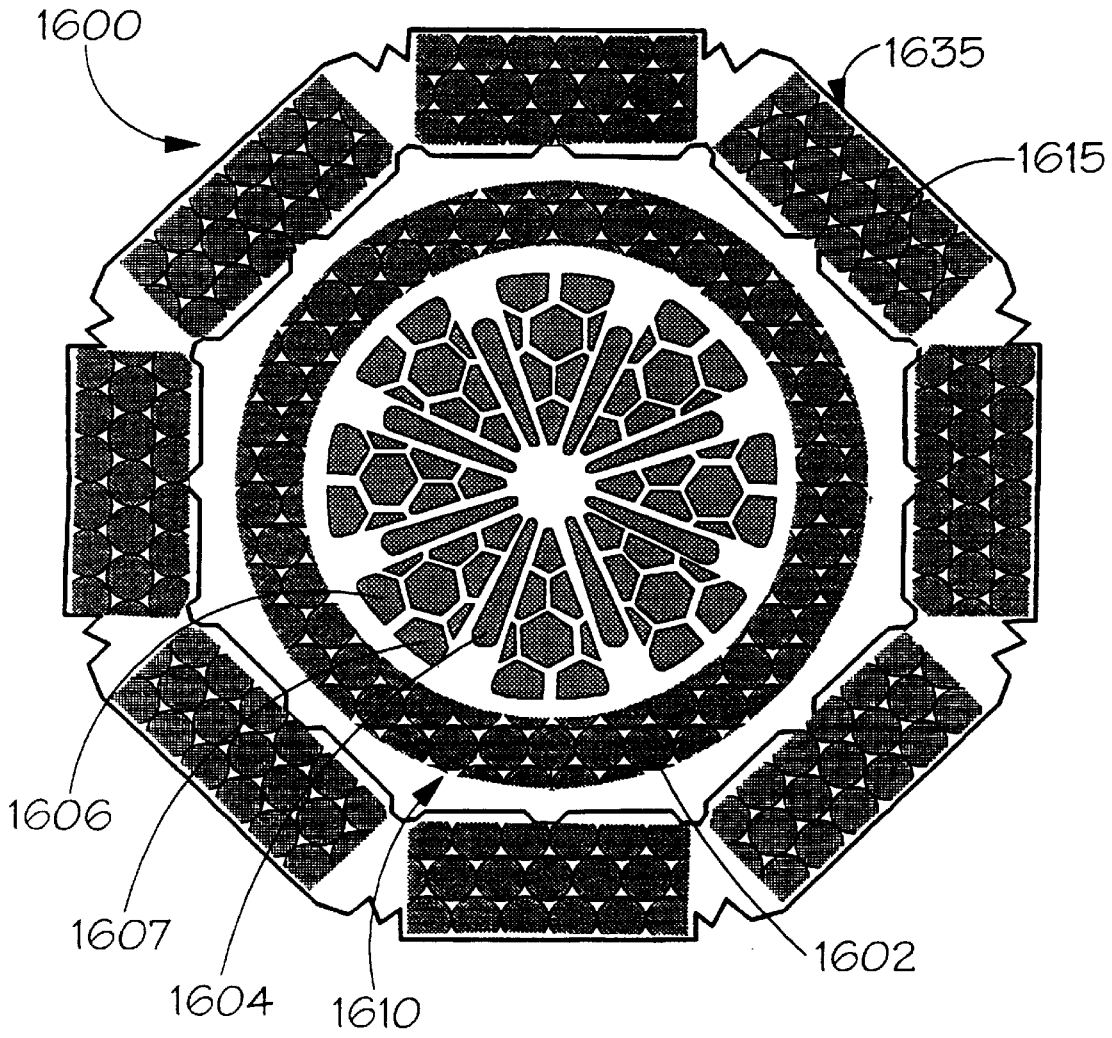
FIG. 16 is a plan view of another alternate heavy-metal patterned region in a further embodiment of the microwaveable laminate of the present invention.

Another variation of the laminate 1400 according to a further embodiment of the present invention is illustrated in plan view in FIG. 16. In the laminate 1600, the patterned regions 1610 and 1635 illustrated in FIG. 16 are substantially similar to the patterned regions 1410 and 1435 illustrated in FIG. 14C, and common characteristics are not recited here. The patterned region 1610 differs from the patterned region 1410 in that only one concentric ring 1602 is present. Further the diameter of the patterned region 1610 is approximately 5.25 inches whereas the diameter of the patterned region 1410 is approximately 6.5 inches. The patterned regions 1635 are substantially the same as the patterned regions 1435.

Figure 17:
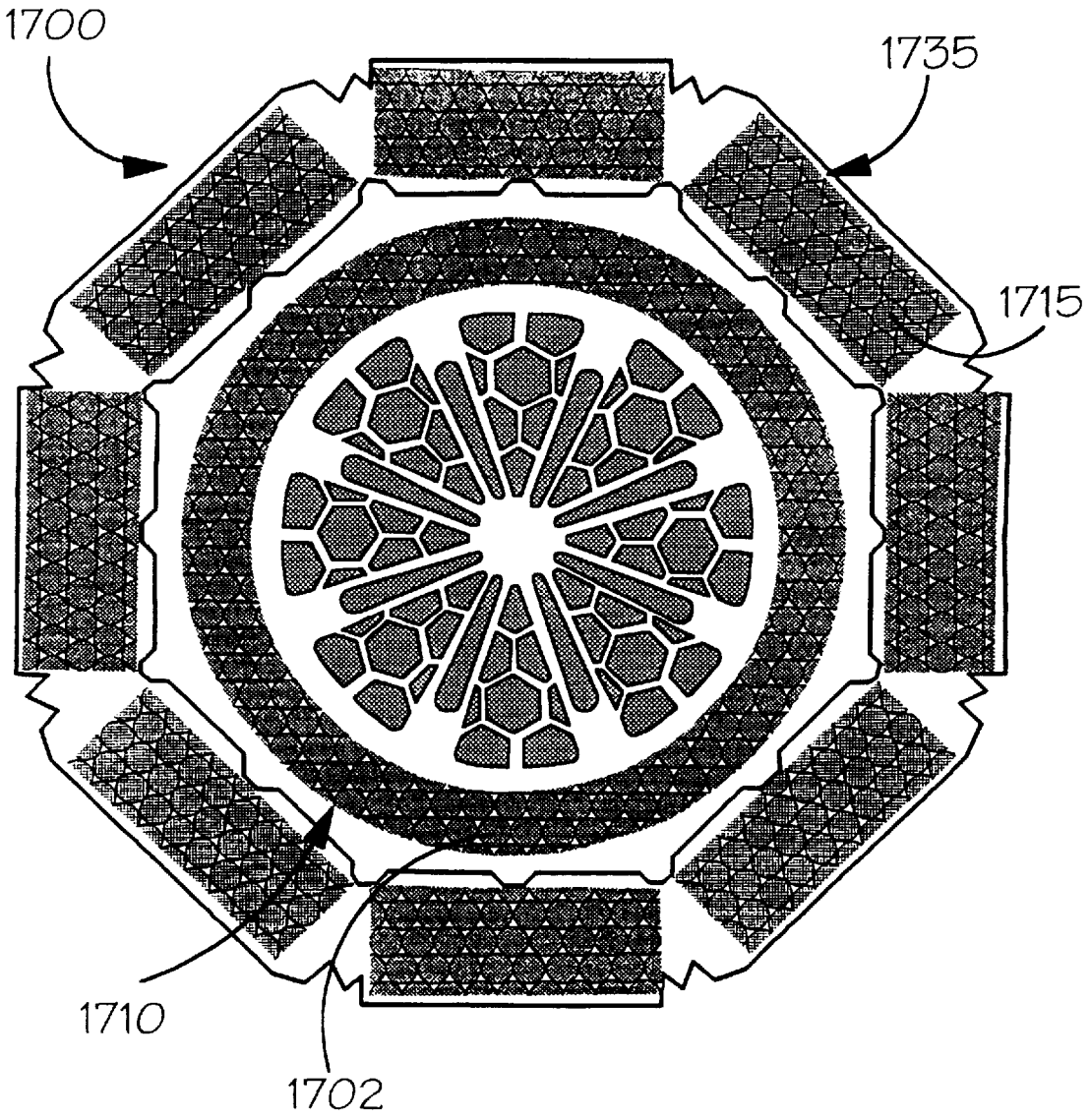
FIG. 17 is a plan view of another alternate heavy-metal patterned region in a further embodiment of the microwaveable laminate of the present invention.

Another variation of the laminate 1400 according to a further embodiment of the present invention is illustrated in plan view in FIG. 17. In laminate 1700, the patterned regions 1710 and 1735 illustrated in FIG. 17 are substantially similar to the patterned regions 1610 and 1635 illustrated in FIG. 16, and common characteristics are not recited here. The patterned regions 1710 and 1735 differ from the patterned regions 1610 and 1635 in that the circular elements 1715 illustrated in FIG. 17 are approximately 0.25 inch in diameter whereas the circular elements 1615 illustrated in FIG. 16 are approximately 0.375 inch in diameter. Further, the adjacent circular elements 1715 are in contact whereas adjacent circular elements 1615 are separated by approximately 0.015 inches at their closest points.

Figure 18:
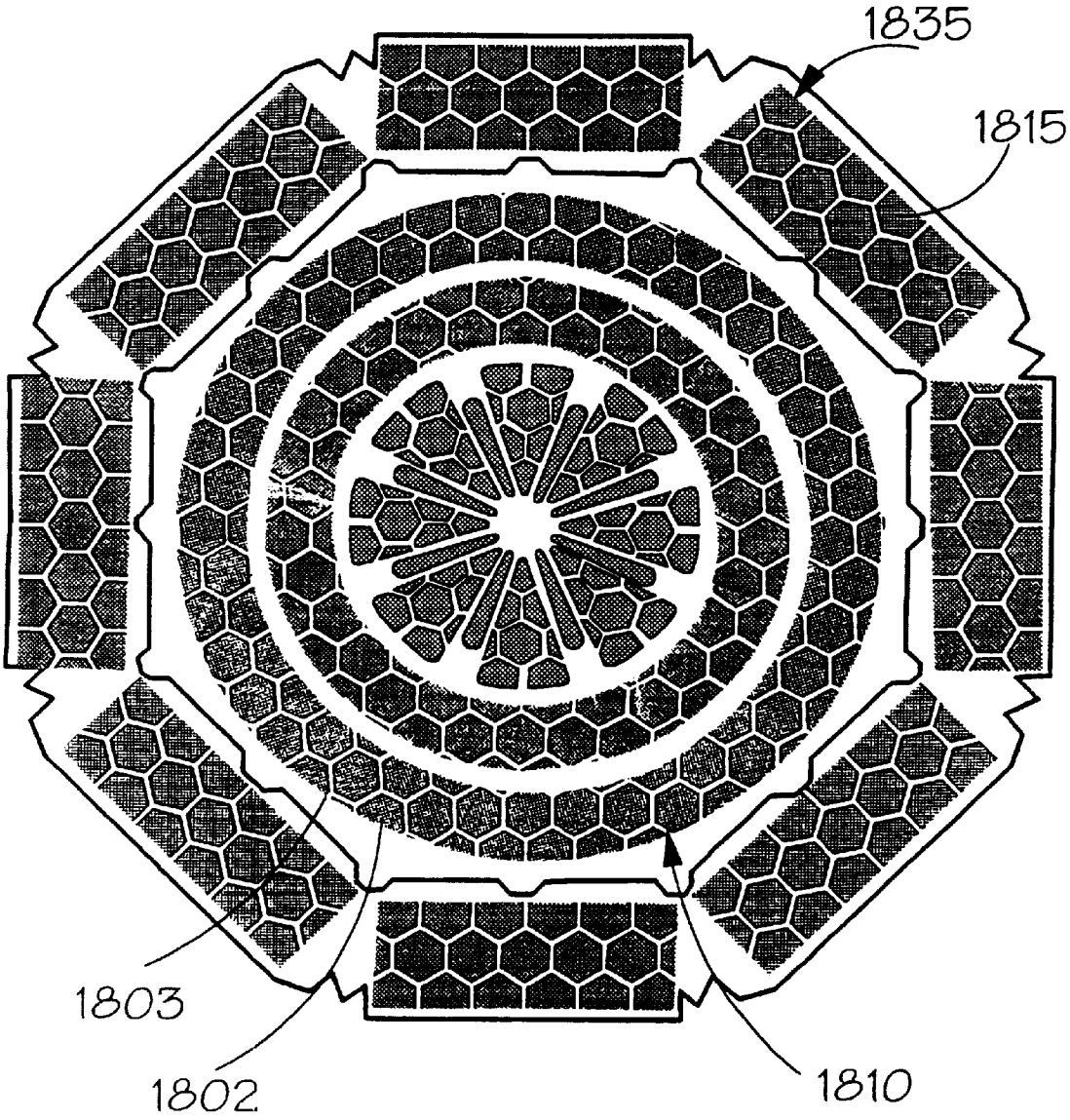
FIG. 18 is a plan view of another alternate heavy-metal patterned region in a further embodiment of the microwaveable laminate of the present invention.

Another variation of the laminate 1400 according to a further embodiment of the present invention is illustrated in plan view in FIG. 18. In laminate 1800 the patterned regions 1810 and 1835 illustrated in FIG. 18 are substantially similar to the patterned regions 1510 and 1535 illustrated in FIG. 15, and common characteristics are not recited here. The patterned regions 1810 and 1835 differ from the patterned regions 1510 and 1535 in that the circular elements 1515 illustrated in FIG. 15 are replaced by hexagonal elements 1815 approximately 0.375 inch in diameter (flat-to-flat) as illustrated in FIG. 18. The hexagonal elements 1815 are arranged in close-packed array, and neighboring hexagonal elements 1815 are separated by approximately 0.015 inch.

Figure 19:
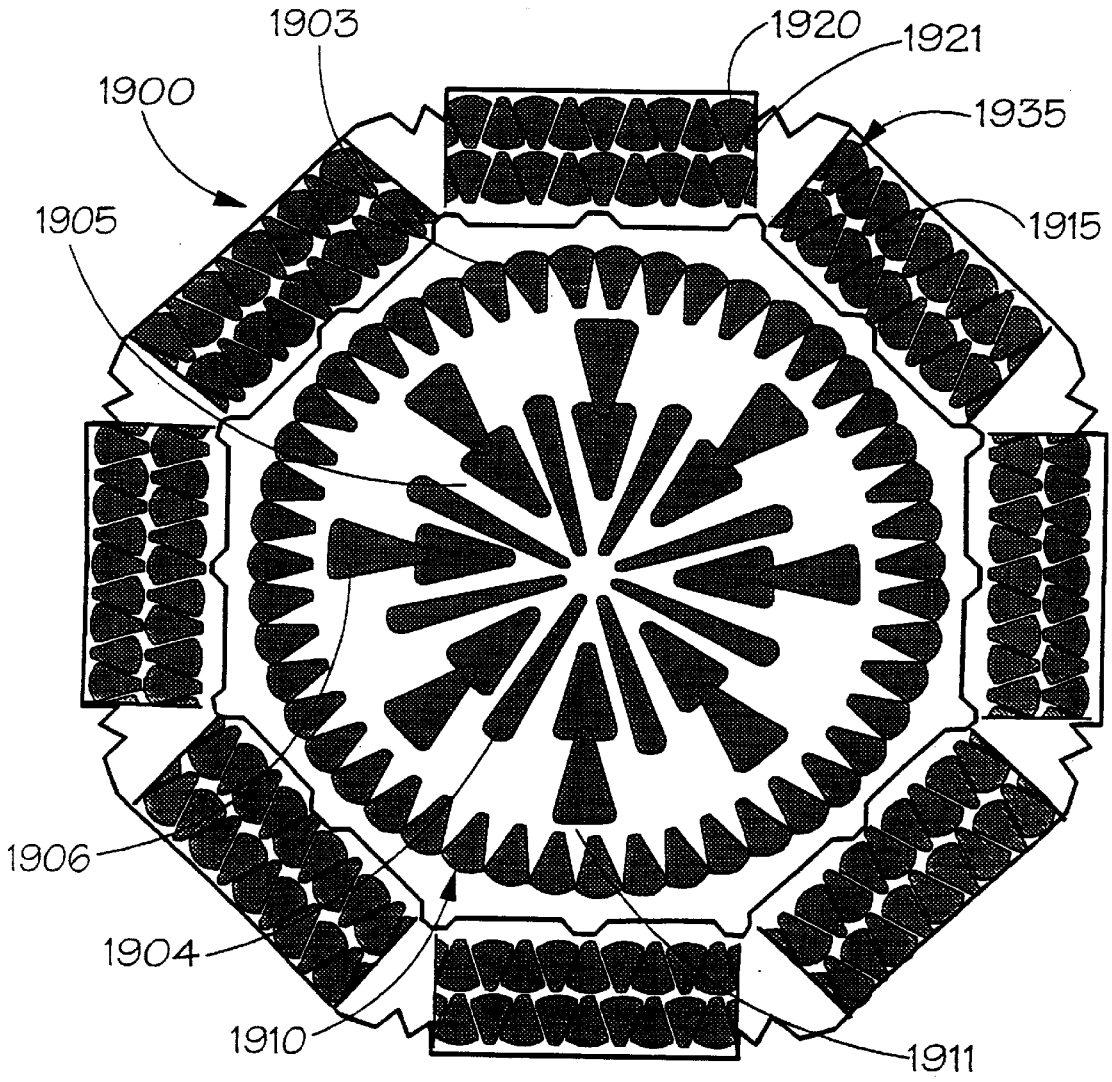
FIG. 19 is a plan view of another alternate heavy-metal patterned region in a further embodiment of the microwaveable laminate of the present invention.

Another variation of the laminate 1400 according to a further embodiment of the present invention is illustrated in plan view in FIG. 19. In laminate 1900 the patterned regions 1910 and 1935 illustrated in FIG. 15 are substantially similar in overall size and shape to the patterned regions 1410 and 1435 illustrated in FIG. 14, but the patterning within corresponding regions differs. The patterned region 1910 is now described. Eight isolated spokes 1904 extend radially from the center of the patterned region 1910. Neighboring spokes 1904 are disposed substantially at an angle of 45 degrees relative to each other as measured at the center of the patterned region 1910. Between each pair of neighboring spokes 1904 are two contacting triangular-shaped elements 1906 approximately 0.6 inch in length extending end-to-end radially from the center of the patterned region 1910 with their narrow ends disposed toward the center. Adjacent spokes 1904 and triangular elements 1906 are separated by spaces 1905. The collection of spokes 1904 and triangular elements 1906 forms an overall circular shape centered at the center of the patterned region 1910.

Surrounding the collection of spokes 1904 and triangular elements 1906 is a concentric ring 1903 of triangular-shaped elements 1915 having the same shape as the triangular elements 1906, but approximately 0.4 inch in length. Adjacent triangular elements 1915 in the concentric ring 1903 are disposed in contact with their narrow ends directed radially toward the center of the patterned region 1910. The concentric ring 1903 is separated from the triangular elements 1906 by a gap 1911.

The rectangular regions 1935 each comprise two rows, an inner row 1920 and an outer row 1921, of triangular elements 1915 disposed approximately circumferentially such that adjacent triangular elements 1915 in a given row are pointed in opposite directions. The spacing between adjacent triangular elements 1915 in a given row 1920 or 1921 is approximately 0.015 inch. Further, triangular elements 1915 in the inner row 1920 adjacent to triangular elements 1915 in the outer row 1921 are disposed such that their narrow ends point in the same direction.

Figure 20:
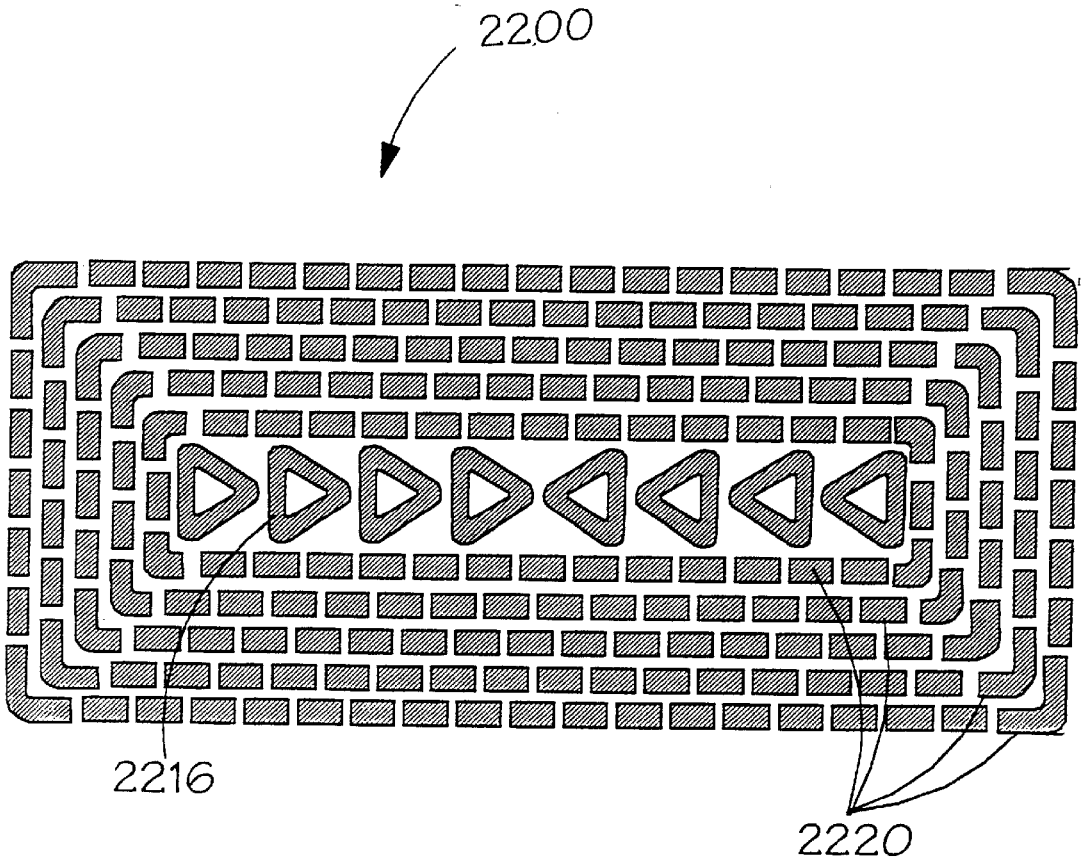
FIG. 20 is a plan view of a further embodiment of a heavy-metal patterned region of the present invention.

A variation of susceptor underlay or shield according to a further embodiment of the present invention is illustrated in plan view in FIG. 20. Heavy-metal patterned region 2200 generally comprises a plurality of linearly disposed triangular heavy-metal formations 2216. The centrally located triangular heavy-metal formations 2216 are surrounded by one or more concentric heavy-metal broken lines 2220 which have a generally rectangular-shape. Preferably the heavy-metal lines used to form patterned region 2200 have a width of approximately 0.125 inches and are separated by gaps having a dimension of approximately 0.0625 inches. The patterned region 2200 preferably has dimensions on the order of 2 inches in height and 5 inches in length. Patterned region 2200 is structured such that it may find particular utility in cooking elongated food items such as sandwiches, etc.

Figure 21:
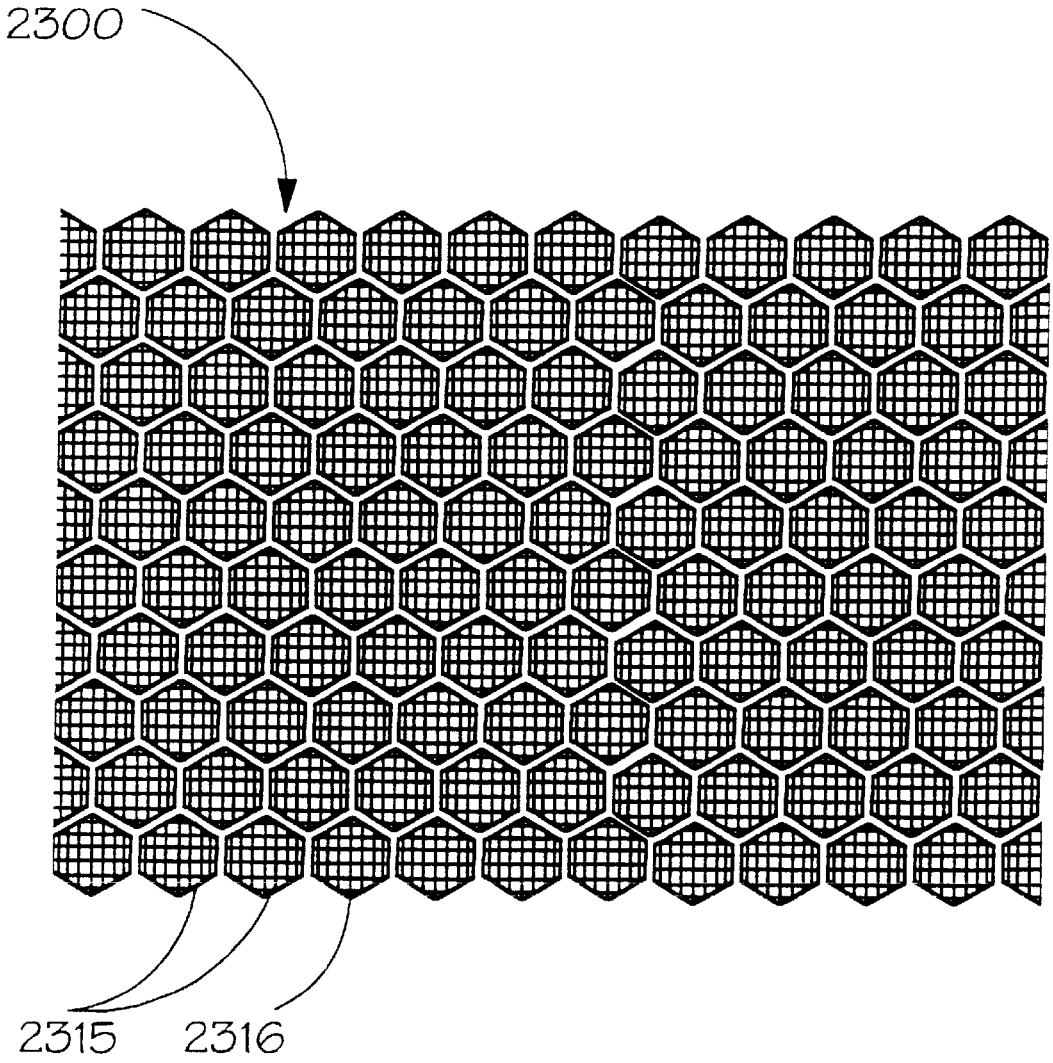
FIG. 21 is a plan view of a further embodiment of a heavy-metal patterned region according to the present invention.

A further variation of a heavy-metal patterned region 2300 is illustrated in FIG. 21. Pattern 2300 generally comprises a plurality of adjacent closely spaced hexagons 2315. Each individual hexagon is formed by a grid of heavy-metal lines 2316. The heavy-metal lines forming the grid 2316 have a width of approximately 0.125 inches which are spaced from each other by a gap on the order of 0.0156 inches. Each individual hexagon is spaced from an adjacent hexagonal formation 2315 by a space of approximately 0.125 inches. A heavy-metal patterned region 2300 formed as described above will generally have a sheet resistance which falls within the shielding range. However, consistent with the principles of the present invention it is feasible to pattern the heavy-metal region 2300 such that the heavy-metal patterned 2300 will possess an overall sheet resistance which falls within the susceptor range.

Though the above embodiments of the present invention may recite aluminum for various heavy-metal regions, it should be understood that a variety of metals or alloys may be used including, but not limited to, aluminum, nickel, iron, tungsten, copper, chromium, stainless steel alloys, nickel-chromium alloys, Nichrome, and Inconel. Aluminum is considered the preferred material. In addition, the thicknesses of various heavy-metal regions are not limited to particular values and may vary such that the sheet resistance of a continuous heavy-metal film is in the range of 1–9 Ω/□. The preferred range of sheet resistance of a continuous heavy-metal film is considered 2–5 Ω/□. Further, the sheet resistance of the patterned heavy-metal microwave-absorbing regions may be within the range of 20–500 Ω/□. The preferred range of sheet resistance for the patterned heavy-metal microwave-absorbing regions is considered 50–200 Ω/□.

Also, a variety of electrically insulating polymeric barrier layers may be used in all embodiments of the present invention including, but not limited to, polyesters, polyimides, polyamides, polyethers, cellophanes, polyolefins, polysulfones, ketones, and combinations thereof. Polyester, polyethylene terephthalate (PET), and polyethylene napthalate (PEN) are considered the preferred materials. In addition, the thickness of a polymeric barrier layer may typically range from 0.2 mil to 2.0 mil, but is not limited to this range. A thickness of 0.5 mil is considered the preferred thickness.

Likewise, a variety of materials may be used for the structural backing layer in all embodiments of the present invention including all of the polymeric materials recited above as well as, but not limited to, food grade paper, food grade paperboard, and mylar. Food grade paper and paperboard are considered the preferred structural backing layers.

In addition, it should be noted that the embodiments of the present invention are not restricted to the methods of production recited above. Specifically, metallic films may be deposited by sputtering, vacuum evaporation, chemical vapor deposition, solution plating including electrodeposition and electroless-deposition, or any other suitable deposition method. Further, either the polymer barrier layer or the structural backing layer or both may be metallized to provide the various heavy-metal regions. Furthermore, the embodiments of the present invention may comprise additional layers beyond those recited above. In addition, patterning and demetallization methods may include the printing of liquid etchants or etch-resistant masking materials by flexographic printing, gravure printing, dot matrix printing, or other suitable methods of printing the desired patterns. Patterning methods involving line screening and half-tone printing are preferred.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A microwaveable laminate comprising:

a first layer substantially transparent to microwave energy, the first layer having an electrically insulating first surface; and a second layer having at least one microwave-absorbing region of patterned electrically conducting film, wherein the at least one microwave-absorbing region comprises conductive portions and nonconductive portions, wherein a section of conductive portion between nonconductive portions is configured to break to inhibit arcing and damage to other regions of the patterned electrically conducting film if the section is exposed to excessive heat during use, wherein the conductive portions have a thickness corresponding to a surface resistivity greater that about 0.5 ohms per square of material (Ω/□) and a surface resistivity less than 10Ω/□, and wherein the patterned electrically conducting film provides an effective electrical sheet resistance that is greater than about 20Ω/□ and less than about 500 Ω/□.

2. The laminate of claim 1, further comprising a third layer substantially transparent to microwave energy, the third layer having an electrically insulating second surface, wherein the second surface is contiguous with the at least one microwave-absorbing region and wherein the third layer is laminated to the first and second layers.

3. The laminate of claim 2, wherein the third layer comprises a food-grade paper material.

4. The laminate of claim 2, wherein the third layer comprises a polymeric material.

5. The laminate of claim 1, wherein the at least one microwave-absorbing region forms a pattern of at least one substantially ring-shaped microwave-absorbing region.

6. The laminate of claim 1, wherein the second layer comprises at least first and second microwave-absorbing regions, the first microwave-absorbing region having an effective sheet resistance greater than that of the second microwave-absorbing region.

7. The laminate of claim 1, wherein the at least one microwave-absorbing region comprises a grid of interconnected lines of electrically conducting film.

8. The laminate of claim 1, wherein the second layer comprises a single microwave-absorbing region of circular shape disposed on the first layer.

9. The laminate of claim 1, wherein the first layer comprises a polymeric material.

10. The laminate of claim 9, wherein the polymeric material is selected from the group consisting of polyesters, polyimides, polyamides, polyethers, cellophanes, polyolefins, polysulfones, polyketones, and combinations thereof.

11. The laminate of claim 1, wherein the first layer comprises a food-grade paper material.

12. The laminate of claim 1, wherein the electrically conductive portions of the patterned electrically conducting film comprise heavy-metal film.

13. The laminate of claim 1, wherein the electrically conductive portions of the patterned electrically conducting film are selected from the group consisting of metals, alloys, dispersions of metals, metal oxides, and combinations thereof.

14. The laminate of claim 1, wherein the patterned electrically conducting film is selected from the group consisting of aluminum, iron, tungsten, nickel, titanium, copper, chromium, stainless steels, and nickel-chromium alloys.

15. The laminate of claim 1, wherein the electrically conductive portions of the patterned electrically conducting film comprise metal having a thickness substantially equal to a thickness of a material having an electrical sheet resistance that is greater than 1Ω/□ and less than 9Ω/□.

16. The laminate of claim 1, wherein the electrically conductive portions of the patterned electrically conducting film have electrical sheet resistances greater than about 2Ω/□ and less than about 5Ω/□.

17. The laminate of claim 1, wherein the at least one microwave-absorbing region possesses an effective electrical sheet resistance greater than about 60Ω/□ and less than about 120Ω/□.

18. The laminate of claim 1, wherein the at least one microwave-absorbing region comprises a first microwave-absorbing region and a second microwave absorbing region, and wherein an effective electrical sheet resistance of the first microwave-absorbing region is greater than an effective electrical sheet resistance of the second microwave-absorbing region.

19. The laminate of claim 1, further comprising at least one microwave-shielding region of electrically conducting film of substantially shielding thickness disposed on the first surface.

20. The laminate of claim 19, wherein the at least one microwave-shielding region overlays the at least one microwave-absorbing region of the second layer.

21. The laminate of claim 1, further comprising at least one microwave-intensifying region of electrically conducting film of substantially shielding thickness disposed on the first surface in a predetermined intensifying pattern of isolated, elongated elements extending radially from the center of the intensifying pattern, whereby microwave energy is intensified in a predetermined region.

22. The laminate of claim 21, wherein the at least one microwave-absorbing region overlays the at least one microwave-absorbing region of the second layer.

23. A package for microwave heating of food products, comprising:

a first layer substantially transparent to microwave energy, the first layer having a first surface disposed near said food product; and a second layer having at least one microwave-absorbing region of patterned electrically conducting film disposed proximate to the first surface, the at least one microwave-absorbing region comprises a conductive portion and nonconductive portions, wherein a section of conductive portion between nonconductive portions is configured to break to inhibit arcing and damage to other areas of the film if the section is exposed to excessive heat during use, wherein the conductive portions have a thickness corresponding to a surface resistivity greater that about 0.5 ohms per square of material (Ω/□) and a surface resistivity less than 10Ω/□, and wherein the patterned electrically conducting film provides an effective electrical sheet resistance that is greater than about 20Ω/□ and less than about 500Ω/□.

24. The package of claim 23, wherein the second layer is laminated to the first layer.

25. The package of claim 23, wherein the second layer is a separate component of the food package that cooperates with the first layer.

26. The package of claim 23, further comprising a barrier layer substantially transparent to microwave energy having an electrically insulating barrier surface, wherein the barrier surface is in contact with the at least one microwave-absorbing region and wherein the barrier layer is laminated to the first layer.

27. The package of claim 26, wherein the at least one microwave-absorbing region forms a pattern of at least one substantially ring-shaped microwave-absorbing region.

28. The package of claim 23, wherein the at least one microwave-absorbing region comprises a first microwave-absorbing region and a second microwave-absorbing region, wherein an effective sheet resistance of the first region is greater than an effective sheet resistance of the second portion.

29. The package of claim 23, wherein the at least one microwave-absorbing region comprises a grid of interconnected lines of electrically conducting film.

30. The package of claim 23, wherein a single microwave-absorbing region of circular shape is disposed on at least the first surface.

31. The package of claim 30, wherein the at least one microwave-shielding region overlays the at least one microwave-absorbing region of the second layer.

32. The package of claim 23, further comprising at least one microwave-shielding region of electrically conducting film of substantially shielding thickness disposed on at least the first surface.

33. The package of claim 32, wherein the at lest one microwave-shielding region and the at least one microwave-absorbing region are disposed on opposing surfaces of the first layer.

34. The package of claim 23, further comprising at least one microwave-intensifying region of electrically conducting film of substantially shielding thickness disposed on at least the first surface in a predetermined intensifying pattern of isolated, elongated elements extending radially from the center of the intensifying pattern, whereby microwave energy is intensified in a predetermined region.

35. The package of claim 34, wherein the at least one microwave-intensifying region and the at least one microwave-absorbing region are disposed on opposing sides of the first layer.

36. The package of claim 34, wherein the at least one microwave-intensifying region and the at least one microwave-absorbing region are both part of the second layer.

37. The package of claim 23, wherein the conductive portions of the patterned electrically conducting film comprise heavy-metal film.

38. The package of claim 23, wherein the conductive portions of the patterned electrically conducting film are selected from the group consisting of metals, alloys, dispersions of metals, metal oxides, and combinations thereof.

39. The package of claim 23, wherein the conductive portions of the patterned electrically conducting film are selected from the group consisting of aluminum, iron, tungsten, nickel, titanium, copper, chromium, stainless steels, and nickel-chromium alloys.

40. The package of claim 23, wherein the first layer comprises a polymeric material.

41. The package of claim 23, wherein the first layer comprises a food-grade paper material.

42. The package of claim 23, further comprising a barrier layer, wherein the barrier layer comprises a polymeric material.

43. The package of claim 23, wherein the barrier layer comprises a food-grade paper material.

* * * * *